US008522542B2

(12) United States Patent
Kimura et al.

(10) Patent No.: US 8,522,542 B2
(45) Date of Patent: Sep. 3, 2013

(54) VARIABLE DISPLACEMENT PUMP

(75) Inventors: Makoto Kimura, Yokohama (JP); Makoto Tada, Zama (JP); Satoshi Nonaka, Atsugi (JP); Hiroyoshi Gomi, Atsugi (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 1058 days.

(21) Appl. No.: 12/539,062

(22) Filed: Aug. 11, 2009

(65) Prior Publication Data

US 2010/0037602 A1 Feb. 18, 2010

(30) Foreign Application Priority Data

Aug. 13, 2008 (JP) ..... 2008-208304

(51) Int. Cl.
*F16D 33/00* (2006.01)

(52) U.S. Cl.
USPC ..... 60/443; 60/445

(58) Field of Classification Search
USPC ..... 60/443, 445
See application file for complete search history.

(56) References Cited

U.S. PATENT DOCUMENTS 2,437,161 A * 3/1948 Kane ..... 60/443
4,507,920 A * 4/1985 Rau ..... 60/443
4,658,584 A * 4/1987 Suzuki et al. ..... 60/443

FOREIGN PATENT DOCUMENTS

JP 2001-294166 A 10/2001
JP 2004-218430 A 8/2004

* cited by examiner

*Primary Examiner* — F. Daniel Lopez
(74) *Attorney, Agent, or Firm* — Foley & Lardner LLP

(57) ABSTRACT

A variable displacement pump includes: a rotor mounted in a body; a cam ring mounted radially outside of the rotor, and arranged to move with a change in an eccentricity of the cam ring with respect to the rotor, wherein change of the eccentricity causes a change in a specific discharge rate; and an electromagnetic actuator arranged to actuate the cam ring for regulating the eccentricity. During control of operation of the electromagnetic actuator, a first response is set slower than a second response, wherein the first response is a response of movement of the cam ring to a change of an input signal in a direction to request a decrease in the specific discharge rate, and the second response is a response of movement of the cam ring to a change of the input signal in a direction to request an increase in the specific discharge rate.

10 Claims, 23 Drawing Sheets

VARIABLE DISPLACEMENT PUMP

BACKGROUND OF THE INVENTION

The present invention relates generally to variable displacement pumps, and more particularly to variable displacement pumps for supplying working fluid to a hydraulic device mounted on a vehicle, for example, to an automotive hydraulic power steering system.

Japanese Patent Application Publication No. 2004-218430 discloses a variable displacement pump for a hydraulic power steering system mounted on an automotive vehicle. The variable displacement pump includes: a body; a rotor mounted in the body, and arranged to be rotated by a driving source; and a cam ring mounted radially outside of the rotor in the body, and arranged to move with a change in an eccentricity of the cam ring with respect to the rotor. Change of the eccentricity causes a change in a specific discharge rate as a quantity of discharge of working fluid per one rotation of the rotor. The variable displacement pump further includes an electromagnetic valve arranged to actuate the cam ring for regulating the eccentricity. The electromagnetic valve is controlled to change a pump discharge rate as a quantity of discharge of working fluid per unit time, with reference to a state of operation of the vehicle.

SUMMARY OF THE INVENTION

In the variable displacement pump disclosed in Japanese Patent Application Publication No. 2004-218430, the inertia of the cam ring may adversely affect or delay a response of movement of the cam ring to a control signal, when the direction of movement of the cam ring is to be reversed. Such a delay is undesirable especially when movement of the cam ring is to be shifted from a direction to reduce the specific discharge rate to a direction to increase the specific discharge rate, because the delay may cause a shortage of working fluid supplied to a load such as a hydraulic power steering system.

In view of the foregoing, it is desirable to provide a variable displacement pump which is capable of supplying a suitable quantity of working fluid without delay, especially when the pump discharge rate is to be increased.

According to one aspect of the present invention, a variable displacement pump for supplying working fluid to a hydraulic device mounted on a vehicle, comprises: a body; a drive shaft rotatably supported by the body; a rotor mounted in the body, and arranged to be rotated by the drive shaft; a cam ring mounted radially outside of the rotor in the body, and arranged to move with a change in an eccentricity of the cam ring with respect to the rotor, wherein change of the eccentricity causes a change in a specific discharge rate as a quantity of discharge of working fluid per one rotation of the rotor; an electromagnetic actuator arranged to actuate the cam ring for regulating the eccentricity; and a controller configured to: receive an input signal outputted from a sensor arranged to measure a state of operation of the vehicle; and output a drive signal to the electromagnetic actuator, wherein the controller is programmed to: control operation of the electromagnetic actuator with reference to the input signal by outputting the drive signal; and set a first response slower than a second response, during control of operation of the electromagnetic actuator, wherein the first response is a response of movement of the cam ring to a change of the input signal in a first direction to request a decrease in the specific discharge rate, and the second response is a response of movement of the cam ring to a change of the input signal in a second direction to request an increase in the specific discharge rate.

According to another aspect of the present invention, a variable displacement pump for supplying working fluid to a hydraulic device mounted on a vehicle, comprises: a body; a drive shaft rotatably supported by the body; a rotor mounted in the body, and arranged to be rotated by the drive shaft; a cam ring mounted radially outside of the rotor in the body, and arranged to move with a change in an eccentricity of the cam ring with respect to the rotor, wherein change of the eccentricity causes a change in a specific discharge rate as a quantity of discharge of working fluid per one rotation of the rotor; an electromagnetic actuator arranged to actuate the cam ring for regulating the eccentricity; and a controller configured to: receive an input signal outputted from a sensor arranged to measure a state of operation of the vehicle; and output a drive signal to the electromagnetic actuator, wherein the controller is programmed to: control operation of the electromagnetic actuator with reference to the input signal by outputting the drive signal; and set a first acceleration smaller than a second acceleration, during control of operation of the electromagnetic actuator, wherein the first acceleration is an acceleration of the cam ring when the cam ring is moving in a direction to reduce the specific discharge rate, and the second acceleration is an acceleration of the cam ring when the cam ring is moving in a direction to increase the specific discharge rate.

According to a further aspect of the present invention, a variable displacement pump for supplying working fluid to a hydraulic device mounted on a vehicle, comprises: a body; a drive shaft rotatably supported by the body; a rotor mounted in the body, and arranged to be rotated by the drive shaft; a cam ring mounted radially outside of the rotor in the body, and arranged to move with a change in an eccentricity of the cam ring with respect to the rotor, wherein change of the eccentricity causes a change in a specific discharge rate as a quantity of discharge of working fluid per one rotation of the rotor; an electromagnetic actuator arranged to actuate the cam ring for regulating the eccentricity; and a controller configured to: receive an input signal outputted from a sensor arranged to measure a state of operation of the vehicle; and output a drive signal to the electromagnetic actuator, wherein the controller is programmed to: control operation of the electromagnetic actuator with reference to the input signal by outputting the drive signal; and wait a predetermined delay period before allowing the cam ring to move in a direction to reduce the specific discharge rate, in response to a change of the input signal in a first direction to request a decrease in the specific discharge rate, during control of operation of the electromagnetic actuator.

DETAILED DESCRIPTION OF THE INVENTION

Figure 1:
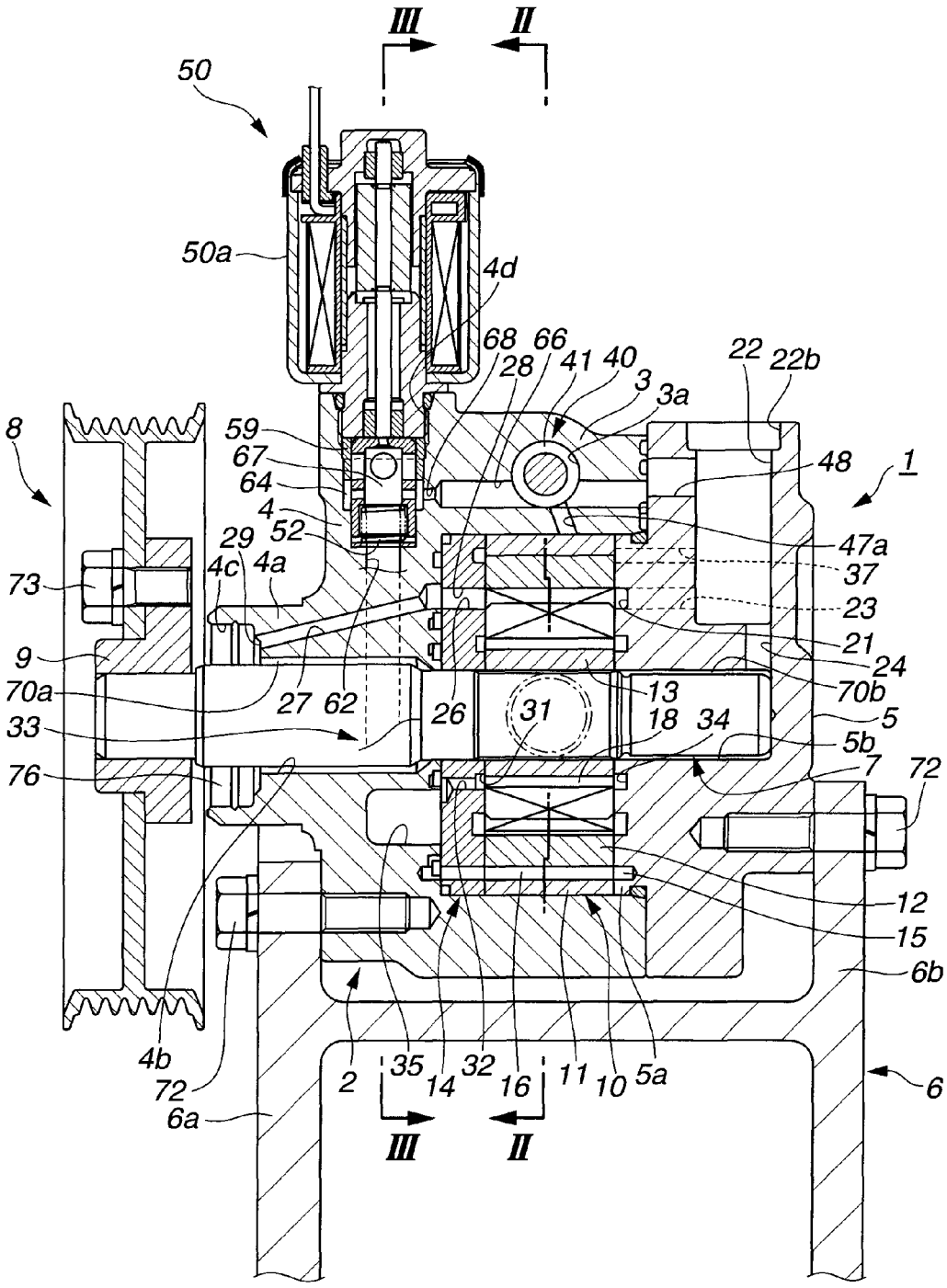
FIG. 1 is a side sectional view of a variable displacement pump according to a first embodiment of the present invention.
Figure 2:
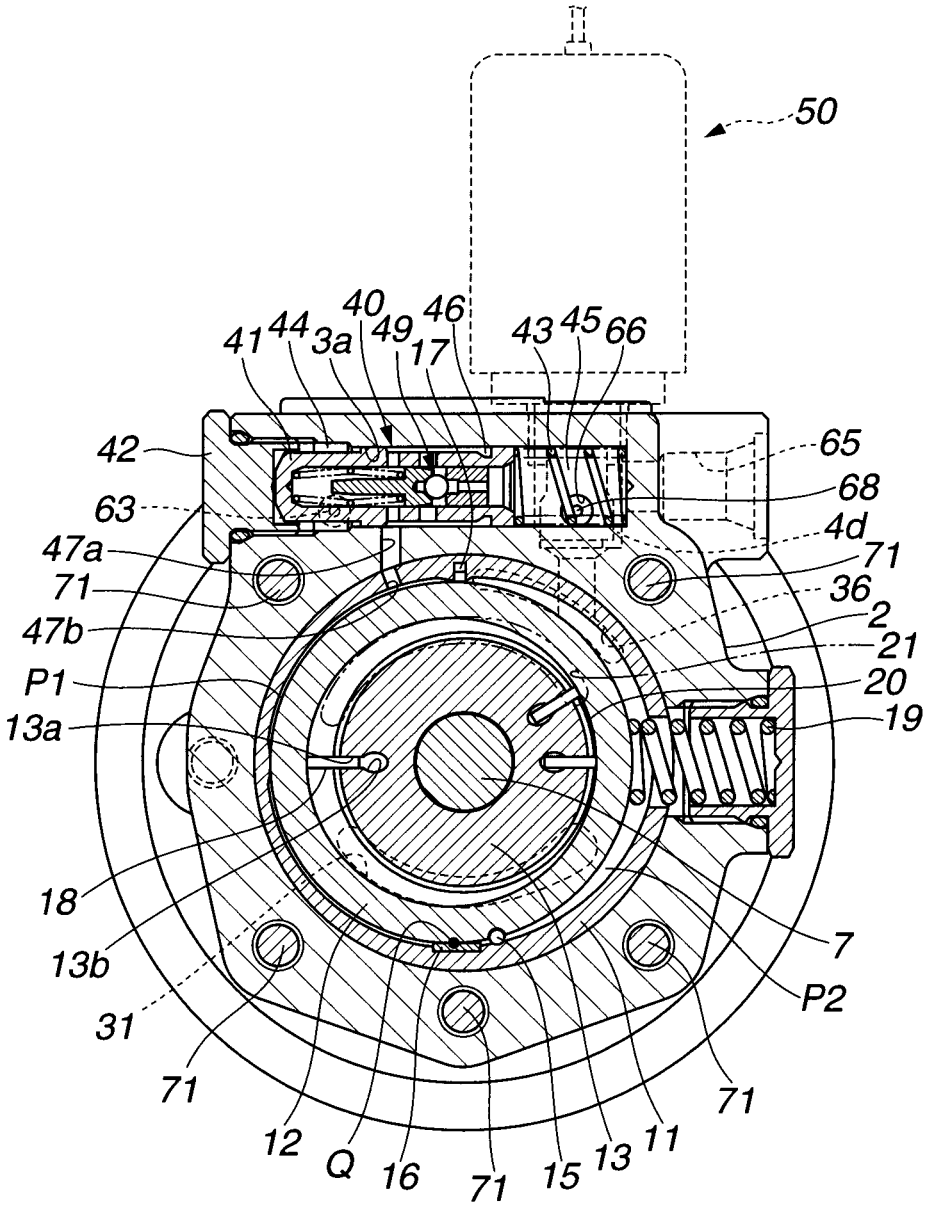
FIG. 2 is a cross-sectional view of the variable displacement pump according to the first embodiment taken along a plane indicated by the line II-II in FIG. 1.
Figure 3:
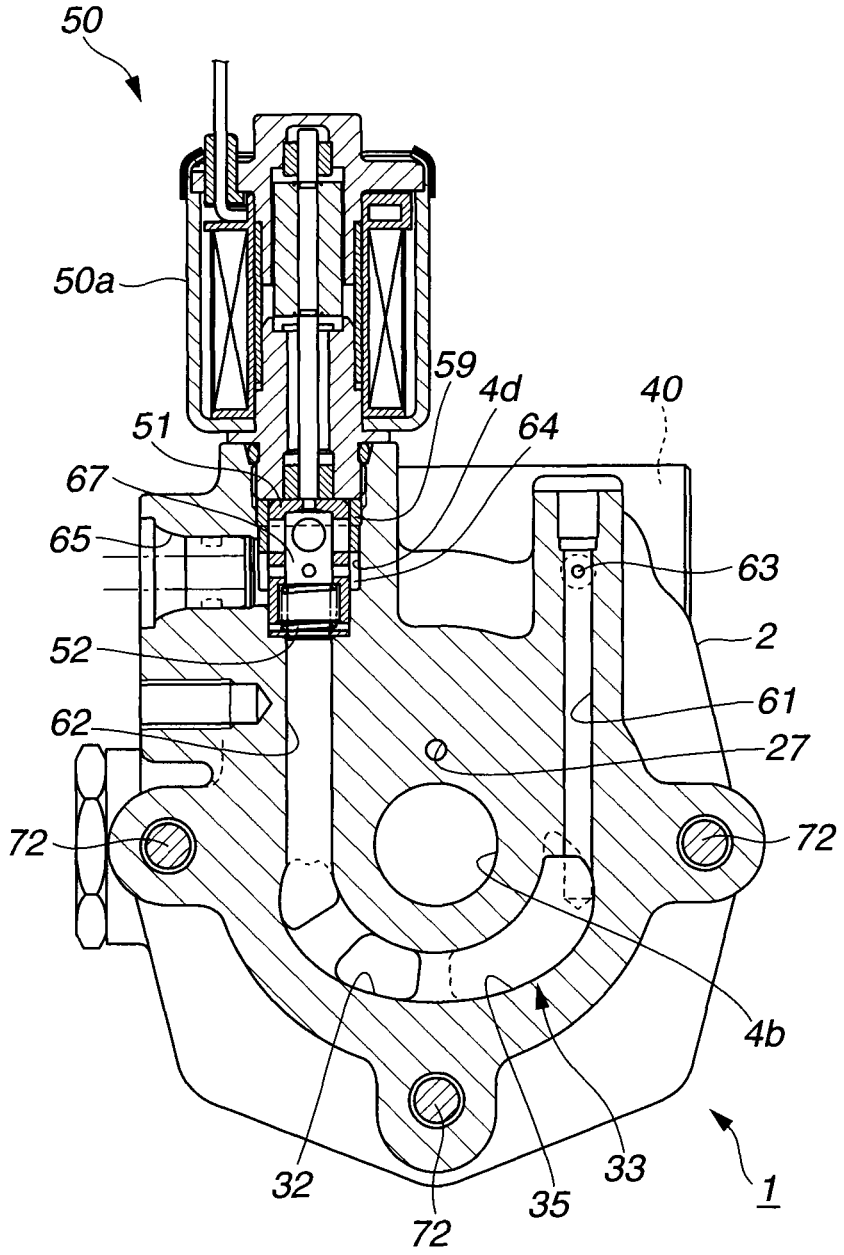
FIG. 3 is a cross-sectional view of the variable displacement pump according to the first embodiment taken along a plane indicated by the line III-III in FIG. 1.

FIGS. 1 to 3 show a variable displacement pump according to embodiments of the present invention. FIG. 1 is a side sectional view of the variable displacement pump. FIG. 2 is a cross-sectional view of the variable displacement pump taken along a plane indicated by the line II-II in FIG. 1. FIG. 3 is a cross-sectional view of the variable displacement pump taken along a plane indicated by the line III-III in FIG. 1. The variable displacement pump is adapted for supplying working fluid to a hydraulic device mounted on a vehicle which is an automotive hydraulic power steering device or system in this example.

As shown in FIGS. 1 to 3, the variable displacement pump includes a body 1 which is composed of separate parts, i.e. a front body 2 and a rear cover 5. Front body 2 includes a cylinder section 3 and a longitudinal end section 4. The cylinder section 3 has a cylindrical shape, and has an open longitudinal end and an opposite longitudinal end closed by the longitudinal end section 4. The open longitudinal end of the cylinder section 3 of front body 2 is closed by rear cover 5. Rear cover 5 is fixed to front body 2 with five bolts 71 which extend in the longitudinal direction of front body 2. Body 1 is attached to a vehicle body not shown with a bracket 6. Bracket 6 is arranged at the bottom of body 1 as viewed in FIG. 1 or closer to a discharge region detailed below, and fixed with bolts 72 to a longitudinal end surface of the longitudinal end section 4 of front body 2 and a longitudinal end surface of rear cover 5. Each bolt 72 extends in the longitudinal direction of body 1. Bracket 6 has a H-shaped section as viewed in FIG. 1, and supports body 1 between a front plate 6*a* fixed to front body 2 and a back plate 6*b* fixed to rear cover 5.

The variable displacement pump further includes a drive shaft 7, a pulley 8, a pumping part 10, a control valve 40, and an electromagnetic valve 50. Drive shaft 7 has a longitudinal axis directed along the longitudinal direction of body 1, and extends from inside of body 1 through the longitudinal end section 4 of front body 2 to outside of body 1. Drive shaft 7 is rotatably supported by body 1. Specifically, drive shaft 7 is supported on a first bearing 70*a* and a second bearing 70*b* for rotation about the longitudinal axis. First bearing 70*a* is mounted in the longitudinal end section 4 of front body 2, whereas second bearing 70*b* is mounted in rear cover 5. Pulley 8 is fixed to the outside longitudinal end of drive shaft 7 for transmitting a driving torque of an engine not shown to drive shaft 7. Pumping part 10 is mounted radially inside the cylinder section 3 of front body 2, and arranged to be driven by drive shaft 7 for pumping working fluid. Control valve 40 is controlled to regulate a pump discharge rate as a quantity, such as mass, weight, or volume, of working fluid discharged by pumping part 10 per unit time. Electromagnetic valve 50 is controlled to regulate the position of a valve element 41 of control valve 40, serving as an electromagnetic actuator arranged to actuate cam ring 12 for regulating the eccentricity, as described in detail below.

Front body 2 includes a hollow cylindrical projection 4*a* substantially at the center of the longitudinal end section 4, which extends toward the pulley 8. Cylindrical projection 4*a* is formed with a bearing-holding portion 4*b* at the inner bore. The bearing-holding portion 4*b* has a larger inner diameter than the outer diameter of drive shaft 7, and retains first bearing 70*a*. The bearing-holding portion 4*b* includes a seal holding portion 4*c* close to the longitudinal end of cylindrical projection 4*a*. The seal holding portion 4*c* has a larger inner diameter than the other part of the bearing-holding portion 4*b*, and retains an annular seal 76.

Rear cover 5 is formed with a fitting projection 5*a* substantially at the center, which is projecting from the inside longitudinal end of rear cover 5 toward the front body 2, and is fitted with the opening of the cylinder section 3 of front body 2. Fitting projection 5*a* is formed with a bearing-holding portion 5*b* substantially at the center, which includes a recess for retaining the second bearing 70*b*.

Pulley 8 is fixed to a boss 9 with a plurality of bolts 73. Boss 9 is cylindrically shaped and press-fixed to drive shaft 7. In this way, pulley 8 is fixed to drive shaft 7.

Pumping part 10 includes a rotor 13, a cam ring 12, an adapter ring 11, and a pressure plate 14. Rotor 13 is arranged to be rotated by drive shaft 7. Cam ring 12 is mounted radially outside of rotor 13, and arranged to move or swing with a change in an eccentricity of cam ring 12 with respect to rotor 13. The eccentricity is defined as a distance between the center of cam ring 12 and the center of rotor 13 as viewed along the axis of rotation of rotor 13. Change of the eccentricity causes a change in a specific discharge rate as a quantity of discharge of working fluid per one rotation of rotor 13, as described in detail below. Adapter ring 11 is fitted and fixed to the inner radial periphery of the cylinder section 3 of front body 2, and arranged radially outside of cam ring 12. Pressure plate 14 is in the form of a disc, and is mounted between the inside longitudinal end surface of the longitudinal end section 4 of front body 2 and one longitudinal end surface of adapter ring 11.

Adapter ring 11 is formed with a cylindrical recess at a bottom portion of the inner radial periphery, as shown in FIG. 2. The recess supports a positioning pin 15 which serves to hold the position of cam ring 12. Adapter ring 11 further includes a rectangular recess at the bottom portion of the inner radial periphery close to and on the left side of the cylindrical recess. The rectangular recess holds a plate 16 which serves as a fulcrum for swinging motion of cam ring 12. Positioning pin 15 does not serve as a fulcrum for swinging motion of cam ring 12, but functions to position cam ring 12, and prevent rotation of cam ring 12 with respect to adapter ring 11. Cam ring 12 is supported to swing about an axis of rotation Q which is located on the upper surface of plate 16.

Adapter ring 11 is formed with a recess at a portion of the inner radial periphery opposite to plate 16. The recess retains a seal 17 having a rectangular section as viewed in FIG. 2. Plate 16 and seal 17 divide the space radially inside of adapter ring 11 and radially outside of cam ring 12 into a first fluid pressure chamber P1 on the left side and a second fluid pressure chamber P2 on the right side as viewed in FIG. 2. As cam ring 12 swings to the left side, the eccentricity of cam ring 12 with respect to rotor 13 increases so as to reduce the volumetric capacity of first fluid pressure chamber P1. On the other hand, as cam ring 12 swings to the right side, the eccentricity of cam ring 12 with respect to rotor 13 decreases so as to reduce the volumetric capacity of second fluid pressure chamber P2.

Rotor 13 is supported with a slight clearance in the longitudinal direction relative to the longitudinal end surface of the fitting projection 5*a* of rear cover 5, and with a slight clearance in the longitudinal direction relative to the longitudinal end surface of pressure plate 14, as shown in FIG. 1. Rotor 13 is arranged to rotate in a counterclockwise direction as viewed in FIG. 2, according to rotation of drive shaft 7. Rotor 13 is formed with a plurality of slots 13*a* arranged at the outer radial periphery and evenly spaced. Each slot 13*a* extends in a radial direction of rotor 13, and holds a rectangular vane 18. Vane 18 is slidably mounted in slot 13*a* for moving out from or back into slot 13*a*. Each slot 13*a* includes a back pressure chamber 13*b* closer to the center of rotor 13. Each back pressure chamber 13*b* has a circular section as viewed in FIG. 2, and receives pressurized working fluid which presses vane 18 from slot 13*a* toward the inner radial periphery of cam ring 12.

The space between cam ring 12 and rotor 13 is divided by vanes 18 into a plurality of pump chambers 20 arranged in a circumferential direction. When rotor 13 rotates according to rotation of drive shaft 7, each pump chamber 20 revolves around the axis of rotation of rotor 13, while the volumetric capacity of pump chamber 20 changes according to the distance between a corresponding portion of the outer radial periphery of rotor 13 and a corresponding portion of the inner radial periphery of cam ring 12. The change of the volumetric capacity of pump chamber 20 serves to pump working fluid. The specific discharge rate, which is defied as a quantity, such as mass, weight, or volume, of working fluid discharged per one rotation of rotor 13, changes with a change in the eccentricity of cam ring 12 with respect to rotor 13.

Second fluid pressure chamber P2 is provided with a spring 19 which has an one longitudinal end retained by a bolt-shaped spring retainer, as shown in FIG. 2. Spring 19 is mounted in a contracted state so as to constantly press the plate 16 in the leftward direction as viewed in FIG. 2, that is, in the direction to increase the specific discharge rate.

The longitudinal end surface of the fitting projection 5*a* of rear cover 5 is formed with a first suction port 21. First suction port 21 is located in a suction region where the volumetric capacity of pump chamber 20 gradually increases according to rotation of rotor 13, and shaped like an arc extending in the circumferential direction. First suction port 21 is connected for fluid communication therewith to a suction passage 22 through a first suction hole 23, in which suction passage 22 and first suction hole 23 are formed in rear cover 5.

Suction passage 22 extends through rear cover 5 and opens to outside of rear cover 5 at a suction opening 22*b*, as shown in FIG. 1. Suction opening 22*b* has a slightly large diameter than the other part of suction passage 22, to be connected by a pipe not shown to a reservoir tank not shown which stores working fluid. In this structure, working fluid is supplied to each pump chamber 20 through the suction passage 22 and first suction hole 23 from the reservoir tank.

Suction passage 22 is connected for fluid communication therewith to a bottom portion of the bearing-holding portion 5*b* of rear cover 5 through a circulation passage 24 which is formed in rear cover 5. Circulation passage 24 serves to receive working fluid leaking from the clearance in the longitudinal direction between rear cover 5 and rotor 13 into the bearing-holding portion 5*b*, and circulate the same to suction passage 22. The leaked working fluid is supplied again to first suction port 21.

Pressure plate 14 is formed with a second suction port 26 facing the first suction port 21. Second suction port 26 has substantially the same shape as first suction port 21. Second suction port 26 is formed with a second suction hole 28 substantially at the center. Second suction hole 28 extends through the pressure plate 14, and opens to a circulation passage 27 which is formed in front body 2. Second suction port 26 is connected for fluid communication therewith to the seal holding portion 4*c* of front body 2 through the circulation passage 27 and second suction hole 28. The seal holding portion 4*c* is formed with a circular groove 29 which communicates with circulation passage 27 under a condition that seal 76 is attached to the seal holding portion 4*c*. An excess amount of working fluid at seal 76 is suctioned by a pumping effect through the groove 29, circulation passage 27 and second suction hole 28 to pump chambers 20. This prevents the excess amount of working fluid from leaking to outside of body 1.

Pressure plate 14 is also formed with a first discharge port 31 at the surface facing the rotor 13. First discharge port 31 is located in a discharge region where the volumetric capacity of each pump chamber 20 gradually decreases according to rotation of rotor 13. First discharge port 31 is shaped like an arc extending in the circumferential direction of rotor 13. First discharge port 31 is connected for fluid communication therewith to a discharge passage 33 through a plurality of discharge holes 32. Working fluid is pressured in each pump chamber 20 by the pumping effect resulting from rotation of rotor 13, and then discharged through the discharge holes 32 to discharge passage 33.

The fitting projection 5*a* of rear cover 5 is formed with a second discharge port 34 at the longitudinal end surface. Second discharge port 34 faces the first discharge port 31, and has substantially the same shape as first discharge port 31. Pressures acting to rotor 13 in the longitudinal direction are in balance, because suction passage 22 and second suction port 26 are symmetric with respect to rotor 13, and first discharge port 31 and second discharge port 34 are symmetric with respect to rotor 13.

Discharge passage 33 is composed of a pressure chamber 35, a first connection passage 61, a second connection passage 62, and a discharge opening 65, as shown in FIG. 3. Pressure chamber 35 has an arced shape, and opens to discharge holes 32. First connection passage 61 extends from an upper portion of the longitudinal end section 4 of front body 2 to an end of pressure chamber 35 closer to first fluid pressure chamber P1, as shown in FIG. 3. First connection passage 61 has one upper end closed by a plug, and guides part of working fluid from pressure chamber 35 to a high-pressure chamber 44 of control valve 40, as detailed below. Second connection passage 62 extends in parallel to first connection passage 61, from an upper portion of the longitudinal end section 4 to an end of pressure chamber 35 closer to second fluid pressure chamber P2. Discharge opening 65 opens at the side periphery of the longitudinal end section 4, and guides working fluid from second connection passage 62 to outside of body 1. Electromagnetic valve 50 is arranged at a connecting point between second connection passage 62 and discharge opening 65.

Control valve 40 is arranged to regulate at least one of an internal pressure of first fluid pressure chamber P1 and an internal pressure of second fluid pressure chamber P2 with valve element 41 which is arranged to be operated by a differential pressure between an upstream side and a downstream side of a metering orifice, as detailed below. Control valve 40 includes a valve bore 3*a*, valve element 41, and a valve spring 43. Valve bore 3*a* is formed in the suction region of the cylinder section 3 of front body 2, extending in a direction perpendicular to the longitudinal axis of drive shaft 7, as shown in FIG. 2. The left open end of valve bore 3*a* is screwed with and closed by a plug 42. Valve element 41 is slidably mounted in valve bore 3*a*. Valve spring 43 is fixed to the bottom end of valve bore 3*a*, and retained in a contracted state to urge the valve element 41 toward the plug 42 in the leftward direction as viewed in FIG. 2.

Valve element 41 divides the inner space of valve bore 3*a* at least into high-pressure chamber 44 and a medium-pressure chamber 45. High-pressure chamber 44 between valve element 41 and plug 42 is connected for fluid communication therewith to pressure chamber 35 through the first connection passage 61. Medium-pressure chamber 45 between valve element 41 and the bottom of valve bore 3*a* where valve spring 43 is mounted is connected for fluid communication therewith to pressure chamber 35 through the second connection passage 62 and a metering orifice 60 as detailed in detail below. Accordingly, high-pressure chamber 44 receives working fluid of a relatively high pressure on an upstream side of metering orifice 60, whereas medium-pressure chamber 45 receives working fluid of a relatively low pressure on a downstream side of metering orifice 60. Valve element 41 is moved by a differential pressure between medium-pressure chamber 45 and high-pressure chamber 44.

Valve element 41 is formed with a low-pressure chamber 46 at the outer radial periphery. Low-pressure chamber 46 is connected for fluid communication therewith to a low pressure passage 48 which is branched from suction passage 22. When the differential pressure between medium-pressure chamber 45 and high-pressure chamber 44 is relatively low so that valve element 41 is moved into a position close to plug 42, then low-pressure chamber 46 is connected for fluid communication therewith to first fluid pressure chamber P1 through a communication passage 47*a* formed in the cylinder section 3 of front body 2, and a communication passage 47*b* formed in adapter ring 11, as shown in FIG. 2. Under this condition, first fluid pressure chamber P1 receives working fluid of a pump suction pressure from suction passage 22. On the other hand, second fluid pressure chamber P2 is formed with a suction pressure introduction port 36. Suction pressure introduction port 36 has an arced shape, and is connected for fluid communication therewith to suction passage 22 through a communication passage 37. Accordingly, second fluid pressure chamber P2 receives constantly working fluid of the pump suction pressure. Under the condition, cam ring 12 is maximally moved to a position such that the specific discharge rate is maximum, and thereby the pump discharge rate is relatively large.

On the other hand, when the differential pressure between medium-pressure chamber 45 and high-pressure chamber 44 is relatively high so that valve element 41 is moved into a position away from plug 42 against the urging force of valve spring 43, then first fluid pressure chamber P1 is disconnected from low-pressure chamber 46, and connected for fluid communication to high-pressure chamber 44. Under this condition, first fluid pressure chamber P1 receives working fluid of a pump discharge pressure, so that cam ring 12 is moved so as to reduce the volumetric capacity of second fluid pressure chamber P2 against the urging force of spring 19, and reduce the eccentricity of cam ring 12 with respect to rotor 13. Accordingly, the specific discharge rate decreases, and the pump discharge pressure relatively decreases. In this way, control valve 40 supplies first fluid pressure chamber P1 selectively with the hydraulic pressure of low-pressure chamber 46 or the hydraulic pressure of high-pressure chamber 44 by movement of valve element 41 according to the differential pressure between the upstream side and the downstream side of metering orifice 60. The pump discharge rate is controlled by regulating the internal pressure of first fluid pressure chamber P1.

Valve element 41 is formed with an inside bore, and provided with a relief valve 49 in the inside bore. Relief valve 49 is set to open, and circulate part of working fluid of medium-pressure chamber 45 through the low pressure passage 48 to suction passage 22, when the internal pressure of medium-pressure chamber 45 exceeds a preset value, i.e. when the hydraulic pressure of the power steering system (as a load) exceeds a preset value.

As shown in FIG. 3, a first orifice 63 is arranged at a connecting point between first connection passage 61 and high-pressure chamber 44, and formed as a small hole. First orifice 63 serves to suppress fluctuations of working fluid introduced into high-pressure chamber 44, and serves as a damper to prevent vibration of valve element 41 due to working fluid.

Figure 4:
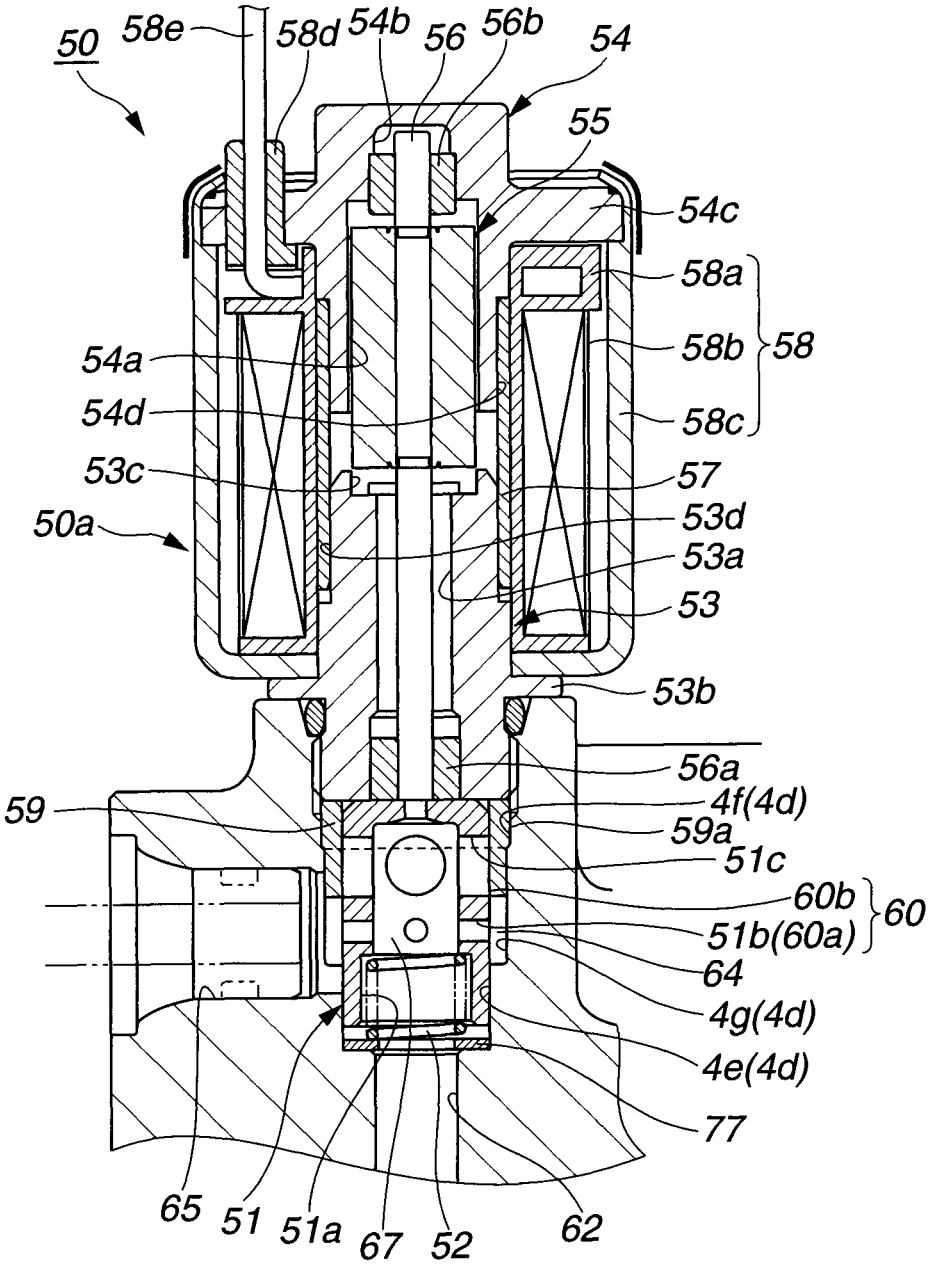
FIG. 4 is an enlarged partial view of the variable displacement pump shown in FIG. 3, showing a metering orifice under a condition that an electromagnetic valve is de-energized.
Figure 5:
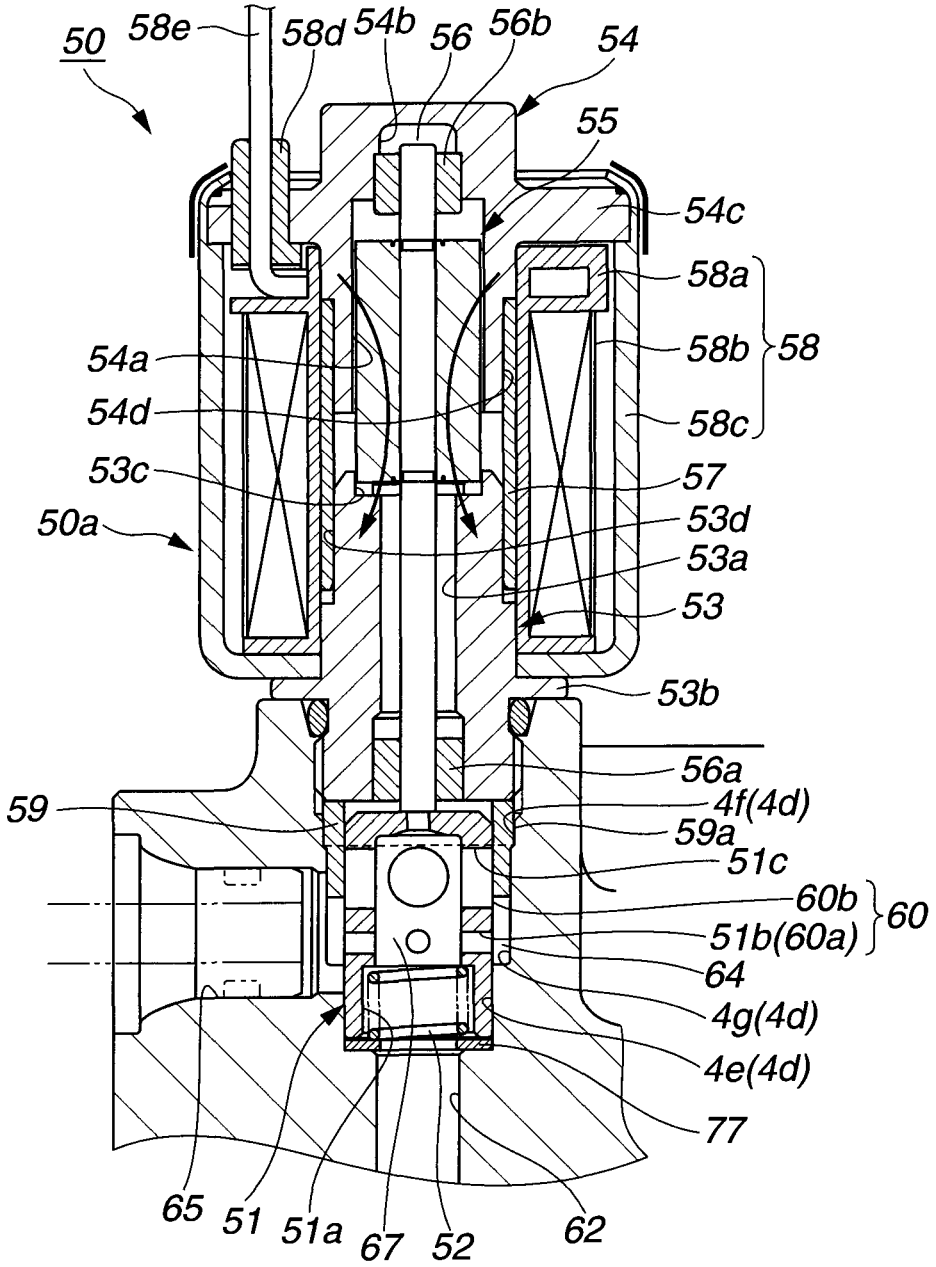
FIG. 5 is an enlarged partial view of the variable displacement pump shown in FIG. 3, showing the metering orifice under a condition that the electromagnetic valve is energized.

FIG. 4 is an enlarged partial view of the variable displacement pump shown in FIG. 3, showing the metering orifice 60 under a condition that the electromagnetic valve 50 is de-energized. FIG. 5 is an enlarged partial view of the variable displacement pump shown in FIG. 3, showing the metering orifice 60 under a condition that the electromagnetic valve 50 is energized. Electromagnetic valve 50 is arranged to press the valve element 41 in a direction to change a state of flow of control valve 40, with the differential pressure between the upstream side and the downstream side of metering orifice 60.

Electromagnetic valve 50 is located in the suction region close to suction opening 22*b* in the vertical direction, and between pulley 8 and control valve 40 in the horizontal direction as viewed in FIG. 1. As viewed in FIGS. 4 and 5, electromagnetic valve 50 is located above the second connection passage 62 or in a position toward which the second connection passage 62 extends. Electromagnetic valve 50 employs a part of the longitudinal end section 4 of front body 2 as a valve body.

Electromagnetic valve 50 is composed of a valve element 51, a return spring 52, and a solenoid unit 50*a*. Second connection passage 62 is formed with a valve bore 4*d* which extends in the vertical direction, and opens at the top surface of the longitudinal end section 4 of front body 2, as viewed in FIG. 4. Valve element 51 is mounted in valve bore 4*d*, and supported for sliding in the longitudinal direction of valve bore 4*d*. Return spring 52 is mounted in valve bore 4*d*, and retained by an annular spacer 77 mounted in valve bore 4*d*, for urging the valve element 51 toward the opening end of valve bore 4*d*. Solenoid unit 50*a* has a longitudinal axis directed in the longitudinal direction of valve bore 4*d*, or in the vertical direction as viewed in FIG. 4, covering the top opening of valve bore 4*d*. When energized, solenoid unit 50*a* changes the position of valve element 51 in the longitudinal direction of valve bore 4*d* against the urging force of return spring 52 by moving a rod 56 toward the valve bore 4*d*, as detailed below.

Valve bore 4*d* has an inner diameter substantially equal to the outer diameter of valve element 51. Valve bore 4*d* includes a small-diameter portion 4*e*, a large-diameter portion 4*f*, and a medium-diameter portion 4*g*, which are arranged toward the opening end of valve bore 4*d*. The small-diameter portion 4*e* supports one longitudinal end portion of valve element 51, and allows the same to slide. The large-diameter portion 4*f* is located close to the open end of valve bore 4*d*, and has a female thread formed to extend over a predetermined range from the open end. The medium-diameter portion 4*g* is formed between the large-diameter portion 4*f* and small-diameter portion 4*e*. In this way, valve bore 4*d* is formed to spread stepwise toward the open end.

As shown in FIG. 4, a holder 59 is mounted in valve bore 4*d*, and has an inner diameter substantially equal to the outer diameter of valve element 51. Holder 59 supports valve element 51, and allows the same to slide. Holder 59 extends in the longitudinal direction from a point in the medium-diameter portion 4*g* of valve bore 4*d* to a point in the large-diameter portion 4*f* of valve bore 4*d*. Holder 59 includes an expanded-diameter portion 59*a* at one longitudinal end which has an outer diameter substantially equal to the inner diameter of the large-diameter portion 4*f* of valve bore 4*d*. The expanded-diameter portion 59*a* is supported between the step between the large-diameter portion 4*f* and the medium-diameter portion 4*g* and a first core 53 which is screwed into the female thread of the large-diameter portion 4*f*.

The step between the medium-diameter portion 4*g* and small-diameter portion 4*e* and the tip of holder 59 defines an annular chamber 64 between the radial inner periphery of valve bore 4*d* and the outer radial periphery of valve element 51. Annular chamber 64 is connected for fluid communication therewith to discharge opening 65, and also to medium-pressure chamber 45 of control valve 40 through a communication passage 66 that is formed to extend straight to control valve 40, as shown in FIG. 2. Communication passage 66 extends from the medium-diameter portion 4*g* of valve bore 4*d* through the valve bore 3*a* of control valve 40, and has one end closed by rear cover 5, as shown in FIG. 1. The connecting point between communication passage 66 and annular chamber 64 is provided with a second orifice 68.

Valve element 51 has a cylindrical shape with one longitudinal end closed, and has a chamber 67 inside. Valve element 51 is arranged so that the open longitudinal end of valve element 51 faces the second connection passage 62, as shown in FIG. 4. The open longitudinal end portion of valve element 51 includes an expanded-diameter portion 51*a* that has an inner diameter slightly larger than the outer diameter of return spring 52. Return spring 52 is mounted between spacer 77 and a longitudinal end surface of the expanded-diameter portion 51*a* of valve element 51.

Valve element 51 is formed with four small-diameter holes 51*b* in the side wall. Small-diameter holes 51*b* are arranged at a certain position in the longitudinal direction of valve element 51, and at intervals of 90 degrees in the circumferential direction. Each small-diameter hole 51*b* extends in a radial direction through the side wall, and hydraulically connects chamber 67 to annular chamber 64. Each small-diameter hole 51*b* is constantly open to annular chamber 64, independently of the position of valve element 51 with respect to valve bore 4*d*. Small-diameter holes 51*b* serve as a constant orifice 60*a* for reducing the hydraulic pressure of working fluid flowing from chamber 67 to annular chamber 64, i.e. reducing the pump discharge pressure.

Valve element 51 is further formed with four large-diameter holes 51*c* in the side wall. Large-diameter holes 51*c* are arranged at a certain position in the longitudinal direction of valve element 51 closer to the closed longitudinal end of valve element 51 than small-diameter holes 51*b*, as shown in FIG. 4, and at intervals of 90 degrees in the circumferential direction or at the same positions in the circumferential direction as the small-diameter holes 51*b*. Each large-diameter hole 51*c* extends in a radial direction through the side wall, and connects chamber 67 to annular chamber 64. Each large-diameter hole 51*c* is just closed by holder 59, under the condition that valve element 51 is in a top position as shown in FIG. 4. As valve element 51 moves downward from the top position, the area of large-diameter hole 51*c* open to annular chamber 64 gradually increases, as shown in FIG. 5. That is, the area of large-diameter hole 51*c* open to annular chamber 64 changes according to the position of valve element 51 in valve bore 4*d*. In this way, large-diameter holes 51*c* serve as a variable orifice 60*b* for reducing the hydraulic pressure of working fluid flowing from chamber 67 to annular chamber 64, i.e. reducing the pump discharge pressure, depending on the area of large-diameter hole 51*c* open to annular chamber 64.

As described above, constant orifice 60*a* and variable orifice 60*b*, which constitute the metering orifice 60 in discharge passage 33, are arranged in parallel between chamber 67 and annular chamber 64. The cross-sectional flow area of variable orifice 60*b* is regulated by solenoid unit 50*a*. In other words, the cross-sectional flow area of metering orifice 60 is regulated by solenoid unit 50*a*.

Solenoid unit 50*a* includes the first core 53, a second core 54, an armature 55, a rod 56, a coupler 57, and a coil unit 58. First core 53 has a longitudinal end portion screwed to the open longitudinal end portion of valve bore 4*d*, and has a through hole 53*a* at the center of first core 53 which extends along the longitudinal axis of first core 53. Second core 54 is arranged facing the other longitudinal end portion of first core 53 with a predetermined longitudinal clearance, and has an armature-holding hole 54*a* at the center of second core 54 which extends along the longitudinal axis of second core 54. Armature 55 is cylindrically shaped, and mounted in armature-holding hole 54*a* for moving into or out of armature-holding hole 54*a*. Rod 56 is inserted and fixed in the center hole of armature 55 for moving as a unit with armature 55. Coupler 57 is in the form of a hollow cylinder, and fit on the outer radial peripheries of first core 53 and second core 54, coupling the confronting end portions of first core 53 and second core 54. Coil unit 58 is mounted radially outside of the coupler 57, first core 53, and second core 54.

First core 53 is generally in the form of a hollow cylinder which is made of a magnetic material. First core 53 includes a flange 53*b*, and a male thread portion. Flange 53*b* is sandwiched between the top surface of the longitudinal end section 4 of front body 2 and one longitudinal end surface of coil unit 58, as shown in FIG. 4. The male thread portion of first core 53 is screwed into the open longitudinal end portion of valve bore 4*d*. First core 53 includes between the flange 53*b* and the male thread portion a seal groove to which an annular seal is attached. This seal serves to seal the opening of valve bore 4*d*. First core 53 holds a supporter 56*a* at the longitudinal end of through hole 53*a* closer to valve element 51. Supporter 56*a* supports one longitudinal end portion of rod 56, and allows the same to slide.

First core 53 is formed with a recess 53*c* at the open longitudinal end closer to second core 54. Recess 53*c* has a diameter substantially equal to the inner diameter of armature-holding hole 54*a* of second core 54. When armature 55 slides downward out from armature-holding hole 54*a*, the longitudinal end of armature 55 is fitted into recess 53*c*. First core 53 is formed with a fitting groove 53*d* which extends in a portion of the outer radial periphery of first core 53 close to second core 54. Fitting groove 53*d* has a smaller diameter than the other part, and is adapted to be fit on coupler 57.

Second core 54 is generally in the form of a hollow cylinder with one longitudinal end closed which is made of a magnetic material. Second core 54 is formed with a recess 54*b* at the bottom of armature-holding hole 54*a*. Recess 54*b* holds a supporter 56*b* which supports the other longitudinal end portion of rod 56, and allows the same to slide. Second core 54 is formed with a flange 54*c* at the upper longitudinal end, as shown in FIG. 4. Flange 54*c* has a radial outer periphery to which one longitudinal end of a yoke 58*c* is swaged. Second core 54 is formed with a fitting groove 54*d* which extends in a portion of the outer radial periphery of second core 54 close to first core 53. Fitting groove 54*d* has a smaller diameter than the other part, and is adapted to be fit on coupler 57.

Armature 55 is made of a magnetic material, and mounted with a slight radial clearance to armature-holding hole 54*a* of second core 54. Armature 55 is moved toward first core 53 by a traction force that is generated by excitation of coil unit 58.

Rod 56 has a longitudinal length such that when armature 55 is in the top position shown in FIG. 4, the bottom end surface of rod 56 is flush with the bottom surface of first core 53. As armature 55 moves out from armature-holding hole 54*a*, rod 56 projects from the bottom surface of first core 53, and pushes the valve element 51 downward.

Coupler 57 is in the form of a hollow cylinder with a thin side wall which is made of a non-magnetic material. Coupler 57 is welded to first core 53 and second core 54 under the condition that coupler 57 is mounted radially outside of and fit over the fitting groove 53*d* and fitting groove 54*d*.

Coil unit 58 includes a bobbin 58*a*, a coil 58*b*, and yoke 58*c*. Bobbin 58*a* is in the form of a hollow cylinder with flanges at both longitudinal ends, and is mounted radially outside of and fit over the first core 53, second core 54, and coupler 57. Coil 58*b* is wounded around the radial outer periphery of bobbin 58*a* between the flanges. Yoke 58*c* is in the form of a hollow cylinder surrounding the bobbin 58*a* and coil 58*b*. Coil 58*b* is connected to a micro processor unit (MPU) 81 through a harness 58*e*. Harness 58*e* extends from coil 58*b* through a grommet 58*d* which is inserted and fixed to a hole in the flange 54*c* of second core 54.

When no excitation current is flowing through the coil 58*b* of solenoid unit 50*a*, no traction force toward first core 53 is applied to armature 55, so that valve element 51 is kept in contact with the bottom surface of first core 53 by the urging force of return spring 52, as shown in FIG. 4. Accordingly, large-diameter holes 51*c* are closed by holder 59, and only small-diameter holes 51*b* are open to annular chamber 64, so that chamber 67 is connected for fluid communication therewith to annular chamber 64 only with small-diameter holes 51*b*. This minimizes the cross-sectional flow area of metering orifice 60, and relatively increases the differential pressure between the upstream side and the downstream side of metering orifice 60. In response, control valve 40 operates to move the cam ring 12 relative to rotor 13 in the direction to reduce the eccentricity of cam ring 12 relative to rotor 13, so that the specific discharge rate decreases, and thereby the pump discharge rate relatively decreases. In this way, control valve 40 is arranged so that the specific discharge rate increases with an increase in the cross-sectional flow area of metering orifice 60.

On the other hand, when excitation current is flowing through the coil 58*b*, a magnetic field occurs as shown in FIG. 5 which is directed from second core 54 toward first core 53, so that a traction force applies armature 55 toward the first core 53. Then, armature 55 with rod 56 moves toward first core 53, and pushes the valve element 51 by rod 56 downward against the urging force of return spring 52. Accordingly, chamber 67 is connected for fluid communication therewith to annular chamber 64 through both of small-diameter holes 51*b* and large-diameter holes 51*c*, so that the cross-sectional flow area of metering orifice 60 increases. The cross-sectional flow area of metering orifice 60 is increased with an increase in the current supplied to coil 58*b*.

In this way, the differential pressure between the upstream side and the downstream side of metering orifice 60 gradually decreases, as the supply current to coil 58*b* gradually increases. In response, control valve 40 operates to move the cam ring 12 relative to rotor 13 in the direction to increase the eccentricity of cam ring 12 relative to rotor 13, so that the specific discharge rate increases, and thereby the pump discharge rate relatively increases. In summary, it is possible to achieve a desired pump discharge rate by operating the solenoid unit 50*a* with control valve 40 so as to regulate the eccentricity of cam ring 12 with respect to rotor 13.

Figure 6:
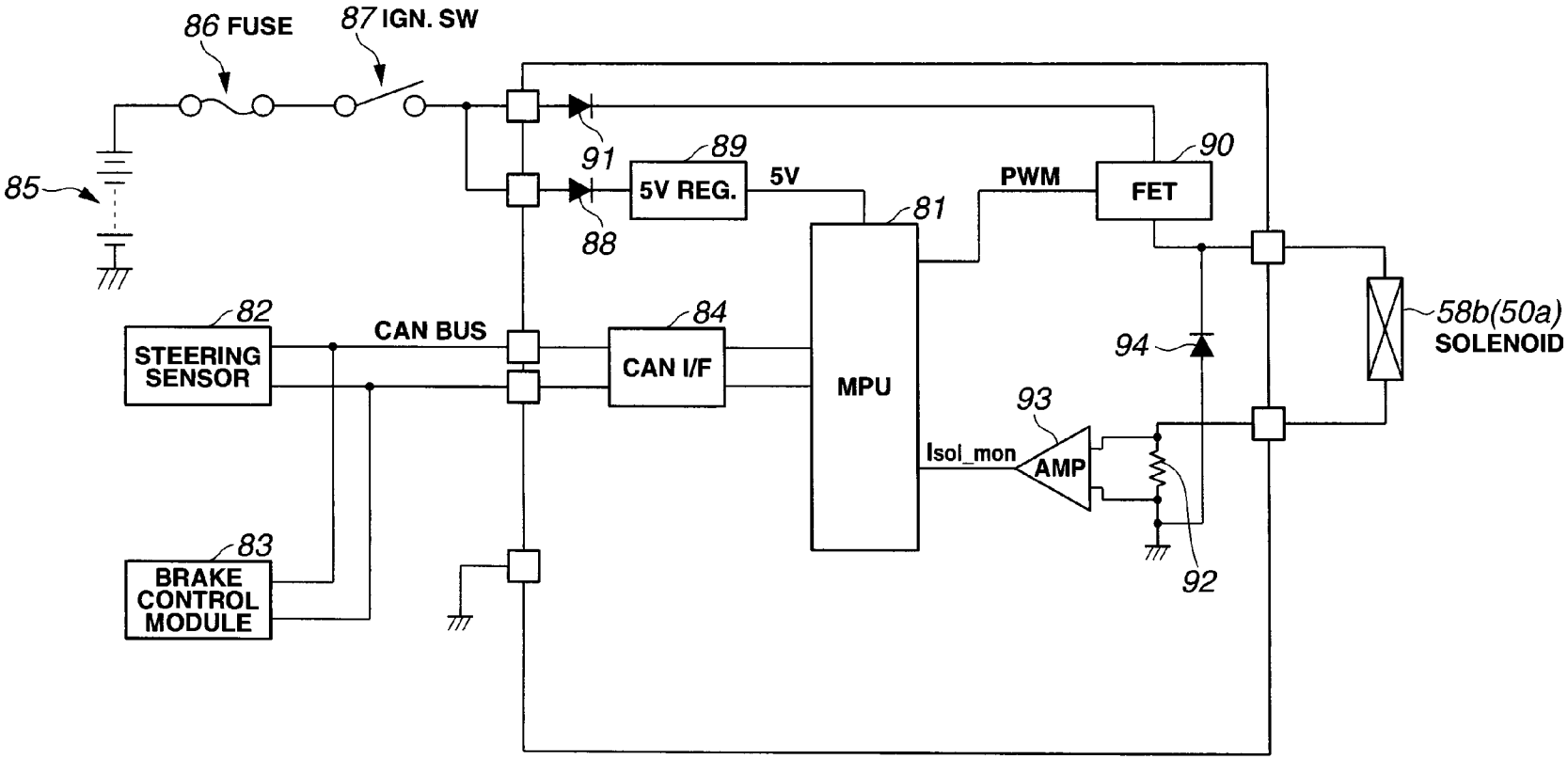
FIG. 6 is a schematic diagram showing a control system of the variable displacement pump for actuating a solenoid unit of the electromagnetic valve shown in FIG. 4.

FIG. 6 schematically shows a control system of the variable displacement pump for actuating the solenoid unit 50*a*. MPU 81 serves as a controller configured to receive an input signal outputted from a sensor arranged to measure a state of operation of the vehicle, and output a drive signal to the electromagnetic actuator, as detailed below. Solenoid unit 50*a* is controlled by MPU 81. MPU 81 receives input of signals through a CAN interface 84 from sensors which measure operating states of the vehicle. The signals include a steering angular speed signal from a steering sensor 82, and a vehicle speed signal from a brake control module 83. The steering angular speed signal indicates an angular speed of a steering wheel operated by an operator, and the vehicle speed signal indicates a travel speed of the vehicle. MPU 81 processes the signals, and then outputs a PWM drive control signal for driving the solenoid unit 50*a*.

MPU 81 is supplied with electric power from a battery 85 which outputs a voltage. The electric power is supplied through a fuse 86, an ignition switch 87, a diode 88, and a regulator 89. Regulator 89 regulates the battery voltage, which is normally equal to about 12V, to a voltage for driving the MPU 81, which is equal to 5V.

The PWM drive control signal is supplied to a field effect transistor (FET) 90 which perform switching. FET 90 switches, with reference to the PWM drive control signal, the current supplied through the fuse 86, ignition switch 87, diode 88, and regulator 89 from battery 85, and supplies an excitation current to coil 58*b* of solenoid unit 50*a*.

One end of coil 58*b* of solenoid unit 50*a* is connected to FET 90, whereas the other end of solenoid unit 50*a* is grounded through a resistance 92 which serves for current measurement. The voltage between the both ends of resistance 92, which occurs according to the current flowing through the coil 58*b*, is amplified through an amplifier (AMP) 93, and then supplied as an actual supply current signal (Isol_mon) to MPU 81. Coil 58*b* is provided with a free wheel diode 94 arranged in parallel to coil 58*b*.

Figure 7:
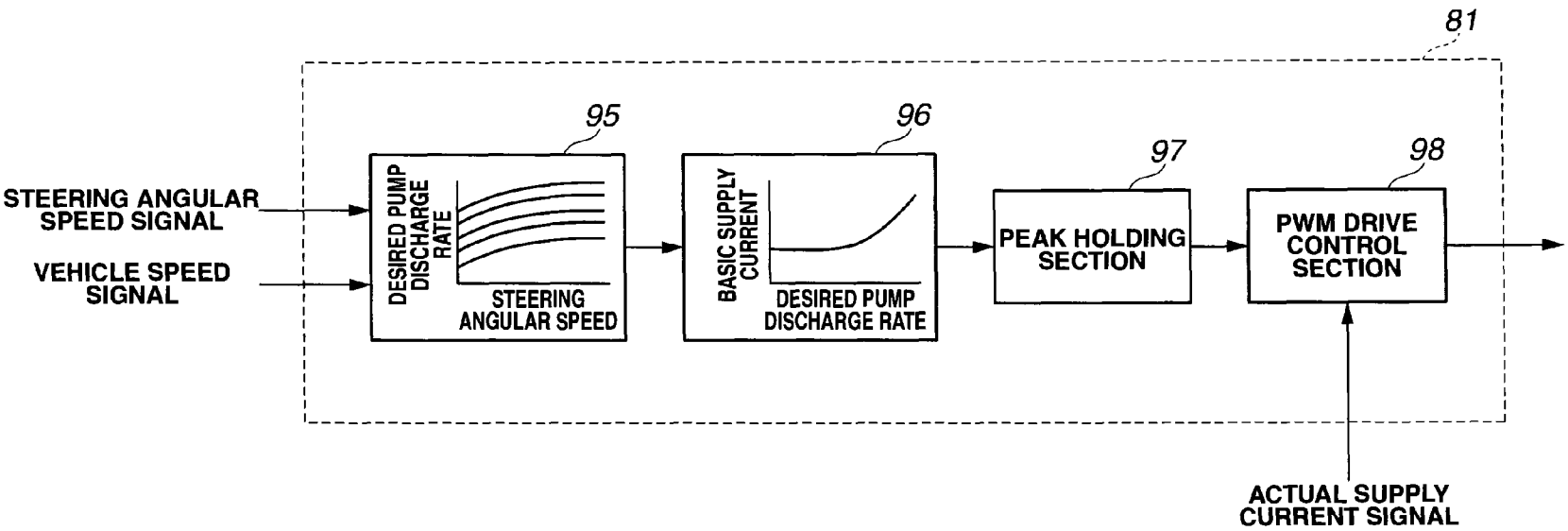
FIG. 7 is a block diagram showing configuration of a micro processor unit (MPU) of the control system shown in FIG. 6.
Figures 8A, 8B, 8C:
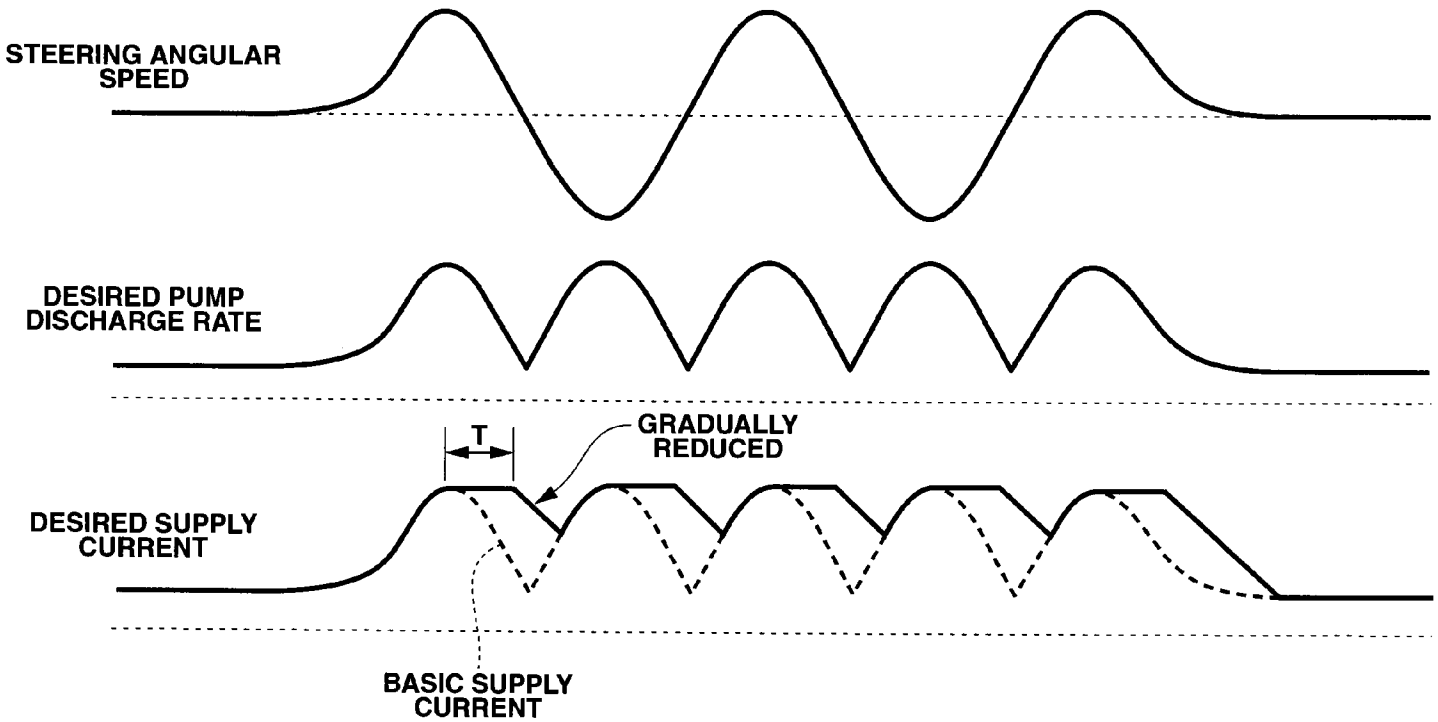
FIGS. 8A, 8B and 8C are time charts showing an example of how the MPU shown in FIG. 7 operates.
Figure 9:
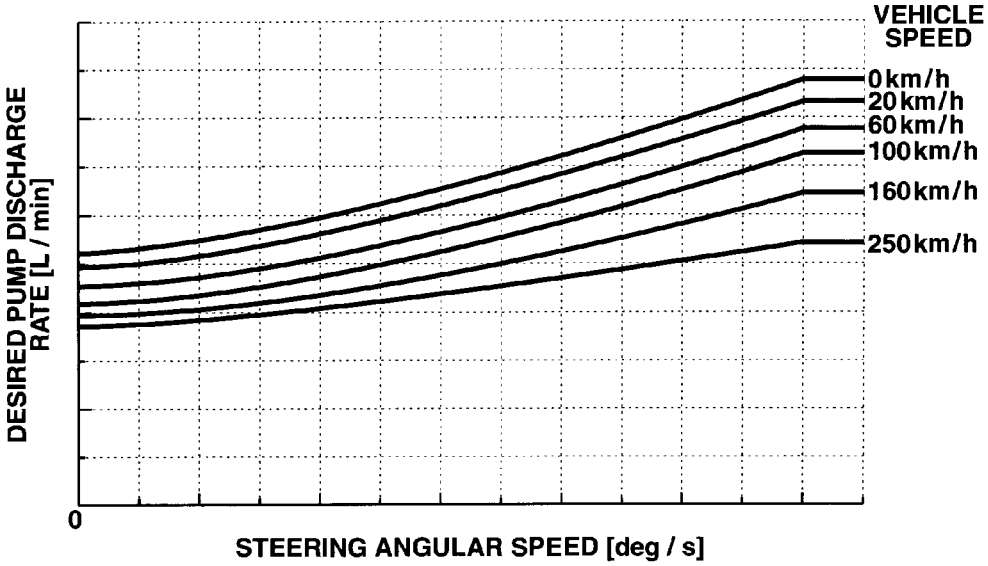
FIG. 9 is a map used by a desired pump discharge rate calculation section of the MPU shown in FIG. 7 for calculating a desired pump discharge rate.
Figure 10:
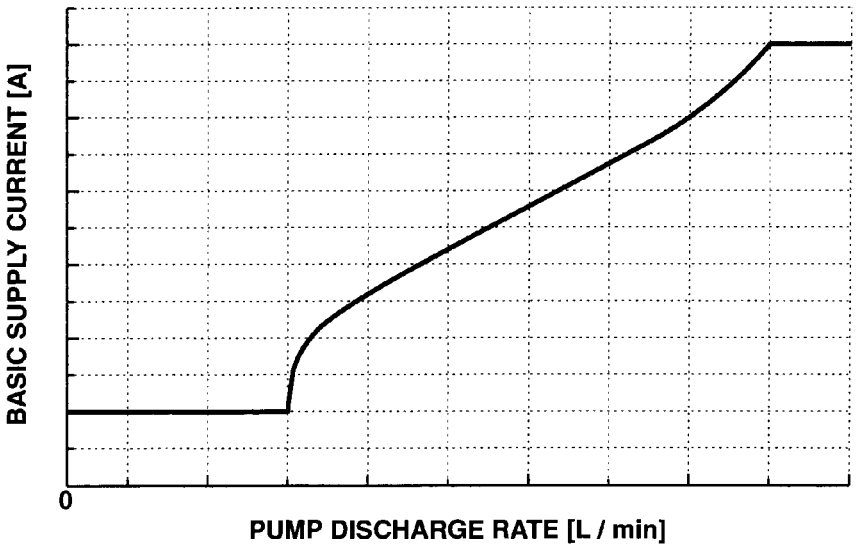
FIG. 10 is a map used by a basic supply current calculation section of the MPU shown in FIG. 7 for calculating a basic supply current.

FIG. 7 is a block diagram showing a configuration of MPU 81, FIGS. 8A, 8B and 8C are time charts showing an example of how MPU 81 operates when a steering angular speed is changed at a constant vehicle speed. FIG. 8A shows changes of the steering angular speed, FIG. 8B shows changes of a desired pump discharge rate, and FIG. 8C shows changes with respect to an desired supply current flowing through the solenoid unit 50*a*. FIG. 9 is a map used by a desired pump discharge rate calculation section of MPU 81 for calculating a desired pump discharge rate. FIG. 10 is a map used by a basic supply current calculation section of MPU 81 for calculating a basic supply current.

MPU 81 is programmed to control operation of the electromagnetic actuator with reference to the input signal by outputting the drive signal. Moreover, MPU 81 is further programmed to set a first response slower than a second response, during control of operation of the electromagnetic actuator, wherein the first response is a response of movement of the cam ring to a change of the input signal in a first direction to request a decrease in the specific discharge rate, and the second response is a response of movement of the cam ring to a change of the input signal in a second direction to request an increase in the specific discharge rate, as detailed below.

As shown in FIG. 7, MPU 81 includes a desired pump discharge rate calculation section 95, a basic supply current calculation section 96, a peak holding section 97, and a PWM drive control section 98. Desired pump discharge rate calculation section 95 calculates a desired pump discharge rate with reference to the steering angular speed signal and the vehicle speed signal. Basic supply current calculation section 96 calculates a basic supply current with reference to the desired pump discharge rate calculated by desired pump discharge rate calculation section 95. Peak holding section 97 calculates a desired supply current with reference to the basic supply current calculated by basic supply current calculation section 96. PWM drive control section 98 calculates a PWM duty ratio by PI control (proportional-integral control) based on a difference between the desired supply current calculated by peak holding section 97 and an actual supply current flowing through the coil 58*b* of solenoid unit 50*a*.

Desired pump discharge rate calculation section 95 calculates the desired pump discharge rate with reference to the steering angular speed signal and the vehicle speed signal, using the map shown in FIG. 9. As shown in FIG. 9, desired pump discharge rate calculation section 95 sets the desired pump discharge rate so that the desired pump discharge rate increases with an increase in the steering angular speed. When the steering angular speed changes as shown in FIG. 8A under a condition that the vehicle speed is constant, the desired pump discharge rate changes as shown in FIG. 8B. Moreover, desired pump discharge rate calculation section 95 sets the desired pump discharge rate so that the desired pump discharge rate decreases with an increase in the vehicle speed, or the desired pump discharge rate increases with a decrease in the vehicle speed, as show in FIG. 9. This allows the operator to perform steering with a small effort, when the vehicle is moving at low speed, for example, when the vehicle is being parked, and also allows the operator to perform steering stably with a rigid feel, when the vehicle is traveling at high speed.

Basic supply current calculation section 96 calculates the basic supply current with reference to the desired pump discharge rate calculated by desired pump discharge rate calculation section 95, using the map shown in FIG. 10. Specifically, basic supply current calculation section 96 sets the basic supply current so that the basic supply current increases with an increase in the desired pump discharge rate. When the desired pump discharge rate changes as shown in FIG. 8B, the basic supply current changes as indicated by a dotted line in FIG. 8C.

Peak holding section 97 sets the desired supply current to the basic supply current when the basic supply current is increasing, as shown in FIG. 8C. When the basic supply current is decreasing, peak holdings section 97 maintains the desired supply current at a value immediately before the basic supply current starts to decrease, for a predetermined holding period (delay period) T. When the holding period is elapsed alter the basic supply current starts to decrease, peak holding section 97 starts to gradually reduce the desired supply current at a predetermined decline rate. Such a gradual reduction can be effective for setting the desired supply current above the basic supply current when the baste supply current is decreasing. Further, such a gradual reduction can thereby be effective for setting the desired supply current such that it is larger when the basic supply current starts to increase after decreasing than when the basic supply current starts to increase after remaining unchanged. In other words, when the basic supply current start to increase under the condition in which the cam ring 12 is moving in the direction to reduce the specific discharge rate, operation of solenoid unit 50*a* is controlled so that the cross-sectional flow area of metering orifice 60 is set such that it is larger than when the basic supply currents starts to increase under the condition in which the cam ring 12 is stationary.

The control described above is effective for delaying the speed of movement of cam ring 12 in the direction to reduce the specific discharge rate when the basic supply current is decreasing, and thereby preventing that when the solenoid unit 50*a* is driven to move the cam ring 12 in the direction to increase the specific discharge rate, the cam ring 12 moves in the direction to increase the specific discharge rate with a delay due to the inertia of cam ring 12, and the delay results in a shortage of working fluid supplied to the hydraulic power steering system. Peak holding section 97 functions as a response delay means for inhibiting or preventing reduction of the specific discharge rate by the solenoid unit 50*a* until the holding period T is elapsed after the basic supply current starts to decrease. As a result, the response of movement of cam ring 12 in the direction to reduce the specific discharge rate to a decrease in the basic supply current is slower than the response of movement of cam ring 12 in the direction to increase the specific discharge rate to an increase in the basic supply current.

Figure 11:
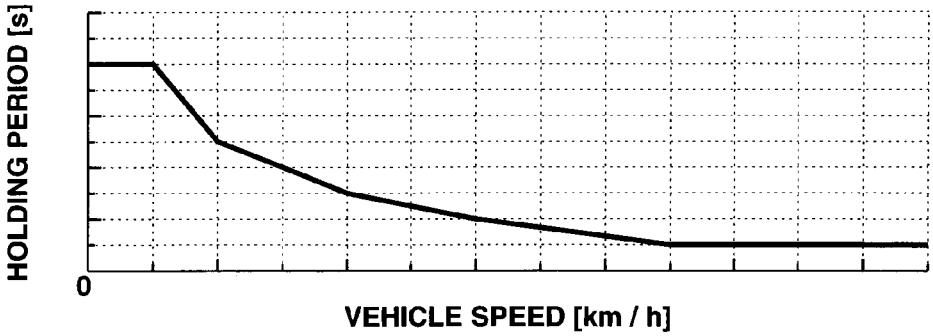
FIG. 11 is a map used by a peak holding section of the MPU shown in FIG. 7 for calculating a holding period of time.
Figure 12:
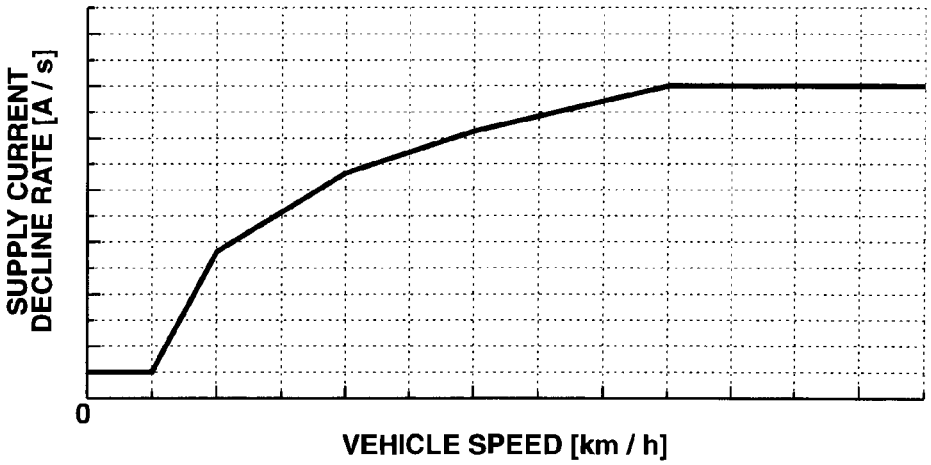
FIG. 12 is a map used by the peak holding section of the MPU shown in FIG. 7 for calculating a supply current decline rate.

FIG. 11 is a map used by peak holding section 97 for calculating the holding period T. FIG. 12 is a map used by peak holding section 97 for calculating the supply current decline rate at which the desired supply current is gradually reduced after the holding period T is elapsed. Peak holding section 97 calculates the holding period T and the supply current decline rate with reference to the vehicle speed, using the maps shown in FIGS. 11 and 12. Specifically, peak holding section 97 sets the holding period T so that the holding period T decreases with an increase in the vehicle speed, and sets the supply current decline rate so that the supply current decline rate increases with an increase in the vehicle speed. Accordingly, when the vehicle is traveling at high speed, the response of movement of cam ring 12 when the desired supply current is decreasing is set faster than when the vehicle is traveling at low speed. The supply current decline rate is a rate of decrease of the desired supply current per unit time.

Figure 13:
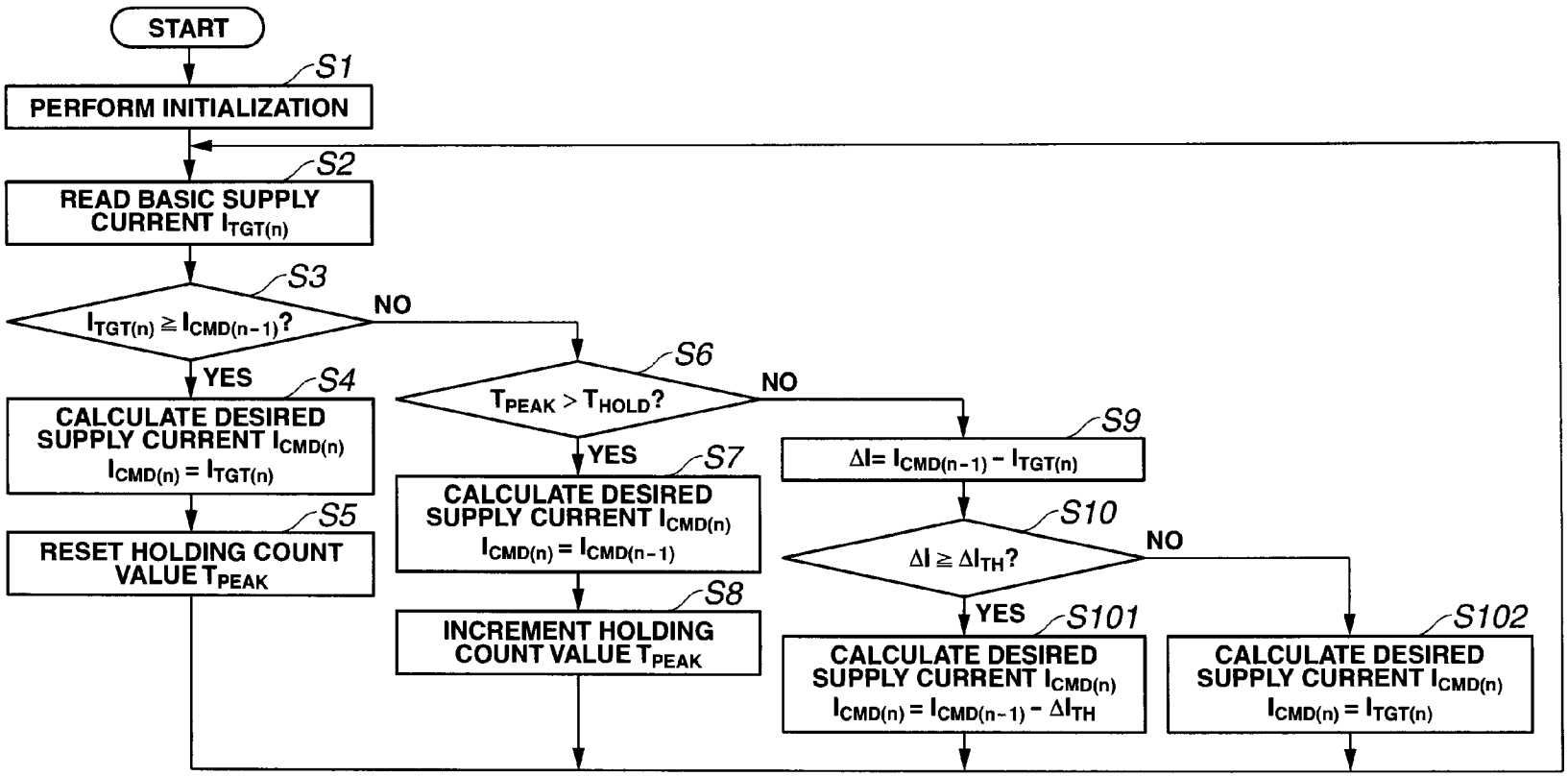
FIG. 13 is a flow chart showing a process performed by the peak holding section of the MPU shown in FIG. 7.

FIG. 13 is a flow chart showing a process performed by peak holding section 97. As shown in FIG. 13, at Step S1, peak holding section 97 performs initialization. At Step S2, peak holding section 97 reads a basic supply current $I_{TGT(n)}$. At Step S3, peak holding section 97 determines whether or not the basic supply current $I_{TGT(n)}$ is larger than or equal to the last value of the desired supply current $I_{CMD(n-1)}$. When the answer to Step S3 is affirmative (YES), then peak holding section 97 proceeds to Step S4 at which peak holding section 97 sets the desired supply current $I_{CMD(n)}$ to the basic supply current $I_{TGT(n)}$.

On the other hand, when the answer to Step S3 is negative (NO), then peak holding section 97 proceeds to Step S6 at which peak holding section 97 determines whether or not a holding count value $T_{PEAK}$ is smaller than a holding set value $T_{HOLD}$. When the answer to Step S6 is YES, then peak holding section 97 proceeds to Step S7 at which peak holding section 97 sets the desired supply current $I_{CMD(n)}$ to the last value of the desired supply current $I_{CMD(n-1)}$. Subsequent to Step S7, at Step S8, peak holding section 97 increments the holding count value $T_{PEAK}$. In this way, when the basic supply current is smaller than the last value of the desired supply current, and the holding period T is not elapsed after the basic supply current becomes smaller than the last value of the desired supply current, then the desired supply current is held to a peak value immediately before the basic supply current starts to decrease, and the holding count value $T_{PEAK}$ is incremented for measurement of the holding period T. The holding set value $T_{HOLD}$ is calculated as a threshold value with reference to the holding period T that is calculated using the map shown in FIG. 11.

When the answer to Step S6 is NO, i.e. when the holding count value $T_{PEAK}$ has reached the holding set value $T_{HOLD}$, then peak holding section 97 proceeds to Step S9 at which peak holding section 97 calculates a difference ΔI between the last value of the desired supply current $I_{CMD(n-1)}$ and the basic supply current $I_{TGT(n)}$. Subsequent to Step S9, at Step S10, peak holding section 97 determines whether or not a condition of $\Delta I \geqq \Delta I_{TH}$ is satisfied. The quantity $\Delta I_{TH}$ is a decrease in the desired supply current which is calculated with reference to the supply current decline rate which is found using the map shown in FIG. 12.

When the answer to Step S10 is YES, then peak holding section 97 proceeds to Step S101 at which peak holding section 97 sets the desired supply current $I_{CMD(n)}$ by subtracting the $\Delta I_{TH}$ from the last value of the desired supply current $I_{CMD(n-1)}$. On the other hand, when the answer to Step S10 is NO, then peak holding section 97 proceeds to Step S102 at which peak holding section 97 sets the desired supply current $I_{CMD(n)}$ to the basic supply current $I_{TGT(n)}$. In this way, when the holding period T is elapsed after the basic supply current becomes below the last value of the desired supply current, the desired supply current $I_{CMD(n)}$ is gradually reduced to the basic supply current $I_{TGT(n)}$ at the supply current decline rate.

When the basic supply current exceeds the last value of the desired supply current, i.e. when the condition of Step S3 is satisfied, then peak holding section 97 proceeds to Step S5 at which peak holding section 97 resets the holding count value $T_{PEAK}$ to zero.

According to the process described above, when the basic supply current starts to decrease, that is, when the specific discharge rate is to be reduced, peak holding section 97 maintains the desired supply current at the peak value of the basic supply current for the holding period T. Accordingly, the movement of cam ring 12 in the direction to reduce the specific discharge rate is delayed by the holding period T. This is effective for allowing the cam ring 12 to move quickly in the direction to increase the specific discharge rate while preventing the cam ring 12 from moving in the direction to reduce the specific discharge rate, when the basic supply current restarts to increase and exceeds the desired supply current during the holding period T after the basic supply current starts to decrease.

Moreover, when the holding period T is elapsed after the basic supply current starts to decrease, the desired supply current starts to decrease at the predetermined decline rate so that the acceleration of cam ring 12 in the direction to reduce the specific discharge rate is suppressed. This is effective for allowing the cam ring 12 to quickly move in the direction to increase the specific discharge rate, when it becomes necessary to increase the specific discharge rate while cam ring 12 is moving in the direction to reduce the specific discharge rate, because the inertial force or inertial resistance of cam ring 12 is smaller. In other words, the acceleration of cam ring 12 in the direction to reduce the specific discharge rate is set smaller than the acceleration of cam ring 12 in the direction to increase the specific discharge rate.

The features described above serve to supply a suitable quantity of working fluid to the hydraulic power steering system so that the hydraulic power steering system can generate a suitable steering assist torque according to operating states of the vehicle, and thereby provide an improved steering feel.

The feature that the cross-sectional flow area of metering orifice 60 is set larger when the basic supply current starts to increase under the condition that the cam ring 12 is moving in the direction to reduce the specific discharge rate than when the basic supply current starts to increase under the condition that the cam ring 12 is stationary, is effective for quickly switching the movement of cam ring 12 from the direction to reduce the specific discharge rate to the direction to increase the specific discharge rate.

The arrangement that the electromagnetic valve 50 is connected to control valve 40 through the communication passage 66, and control valve 40 is indirectly controlled with the electromagnetic valve 50 by regulating the cross-sectional flow area of metering orifice 60 so as to regulate the differential pressure between high-pressure chamber 44 and medium-pressure chamber 45 in control valve 40, requires no large force to be generated by electromagnetic valve 50, and therefore results in a quick response of electromagnetic valve 50 or solenoid unit 50*a*.

The structure that the metering orifice 60 is composed of constant orifice 60*a* and variable orifice 60*b* which are arranged in parallel, is advantageous, because metering orifice 60 can produce at least a minimum pump discharge rate with constant orifice 60*a* even if variable orifice 60*b* is constantly closed due to a failure of electromagnetic valve 50.

The configuration that the desired pump discharge rate calculation section 95 calculates the desired pump discharge rate with reference to the vehicle speed, is effective for supplying a suitable quantity of working fluid to the hydraulic power steering system depending on the vehicle speed. The increase of the desired pump discharge rate with a decrease in the vehicle speed is effective for achieving a soft steering at low speed, and achieving a rigid and stable steering feel at high speed.

Figure 14:
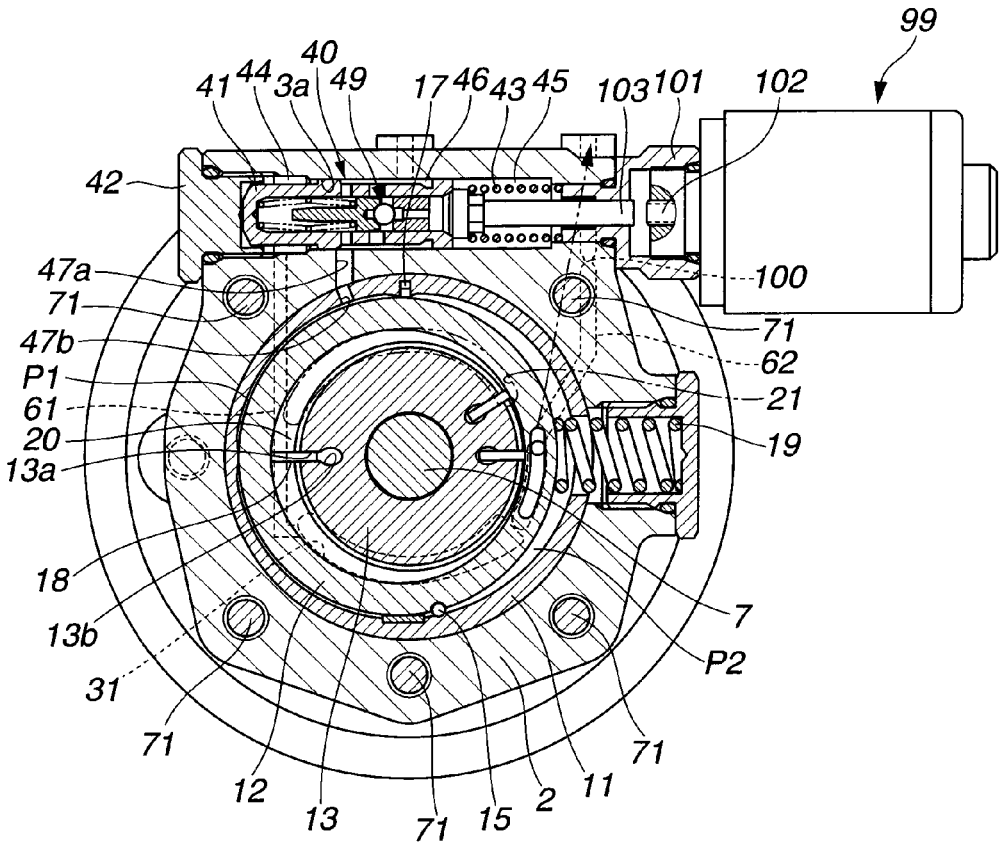
FIG. 14 is a cross-sectional view of a variable displacement pump according to a modification of the first embodiment.

The arrangement that the control valve 40 is connected to electromagnetic valve 50 through the communication passage 66 so that control valve 40 is controlled indirectly by changing the cross-sectional flow area of metering orifice 60 with electromagnetic valve 50, may be modified as shown in a modification shown in FIG. 14 where a solenoid unit 99 is additionally provided instead of electromagnetic valve 50 for directly pressing the valve element 41 of control valve 40. In the modification, second connection passage 62 is provided with a constant orifice 100 which constitutes a metering orifice. The other part of the variable displacement pump is the same as in the first embodiment.

Specifically, the medium-pressure chamber 45 of control valve 40 is formed with a threaded bore to which an adapter 101 is screwed. Solenoid unit 99 is fixedly mounted to the threaded bore through the adapter 101 under a condition that a rod 102 of solenoid unit 99 is directed toward the valve element 41. The valve element 41 is provided with a rod 103 which extends through the medium-pressure chamber 45 and is slidably supported on the inner radial periphery of adapter 101. The rod 103 and rod 102 are coaxially mounted and directed to each other.

When solenoid unit 99 is energized, the rod 102 of solenoid unit 99 travels out, and thereby presses the rod 103 toward the high-pressure chamber 44, so as to move the valve element 41 toward the plug 42. As a result, the cam ring 12 moves in the direction to increase the specific discharge rate.

With the arrangement described above, the variable displacement pump according to the modification produces similar advantageous effects as in the first embodiment.

Figure 15:
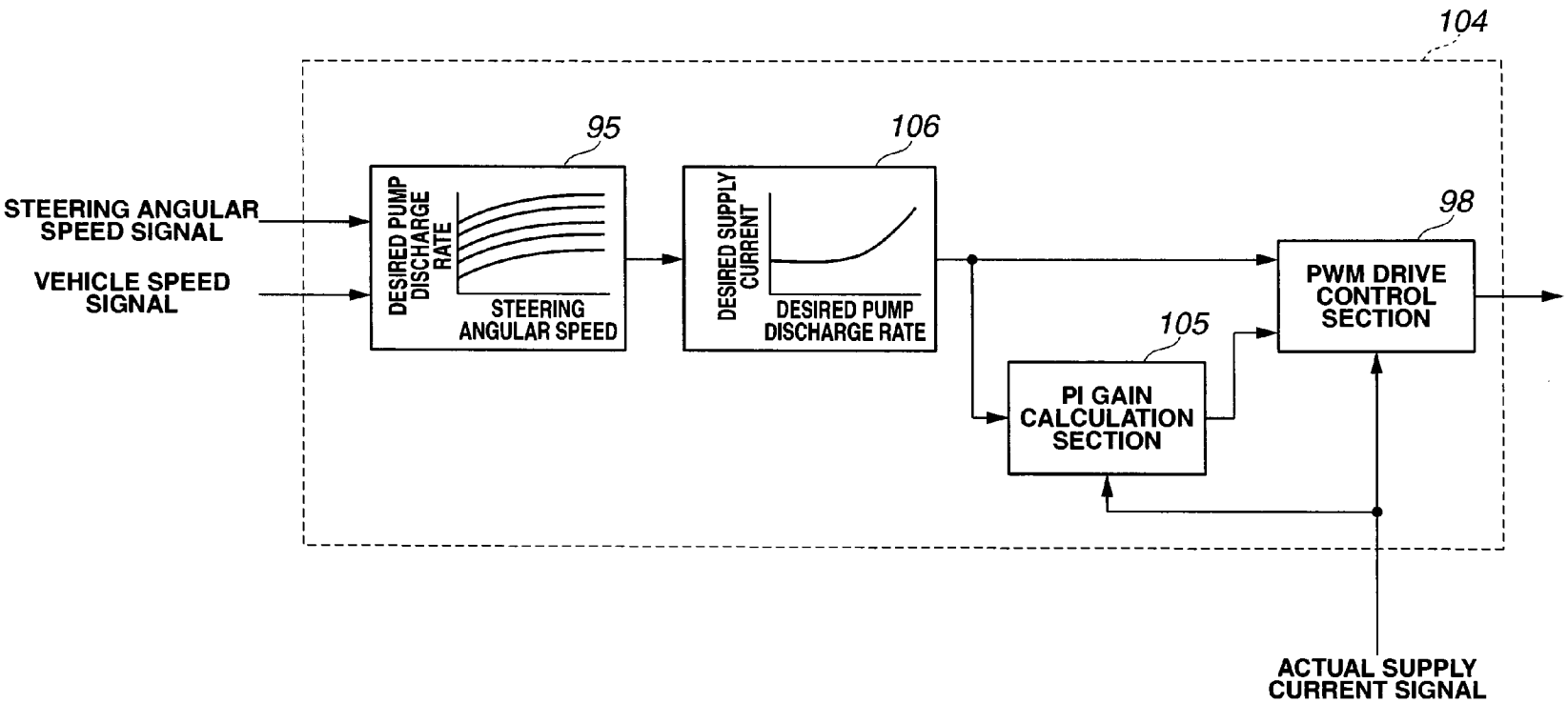
FIG. 15 is a block diagram showing configuration of an MPU of a variable displacement pump according to a second embodiment of the present invention.
Figure 16:
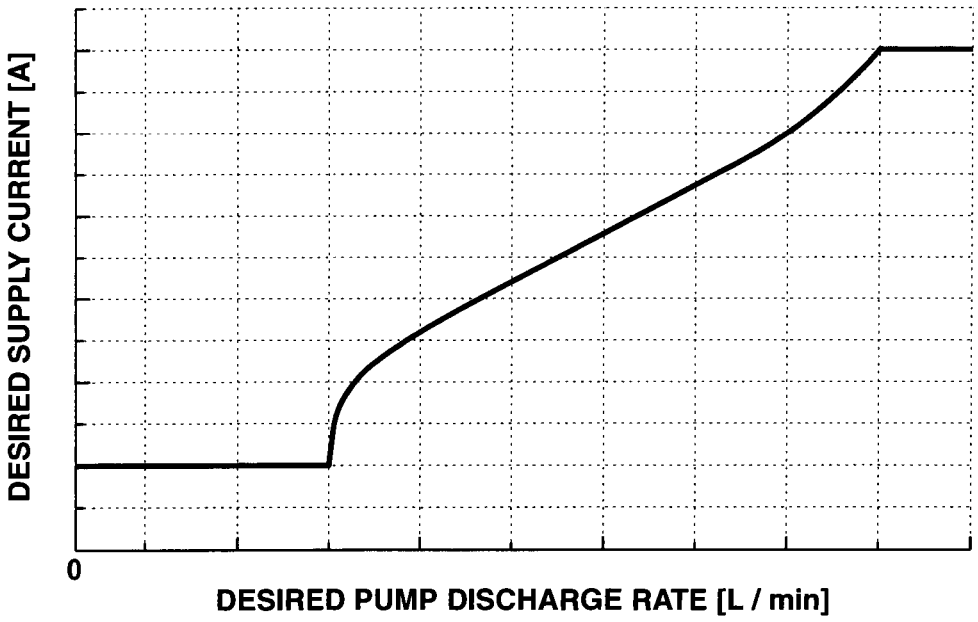
FIG. 16 is a map used by a desired supply current calculation section of the MPU shown in FIG. 15 for calculating a desired supply current.
Figures 17A, 17B, 17C:
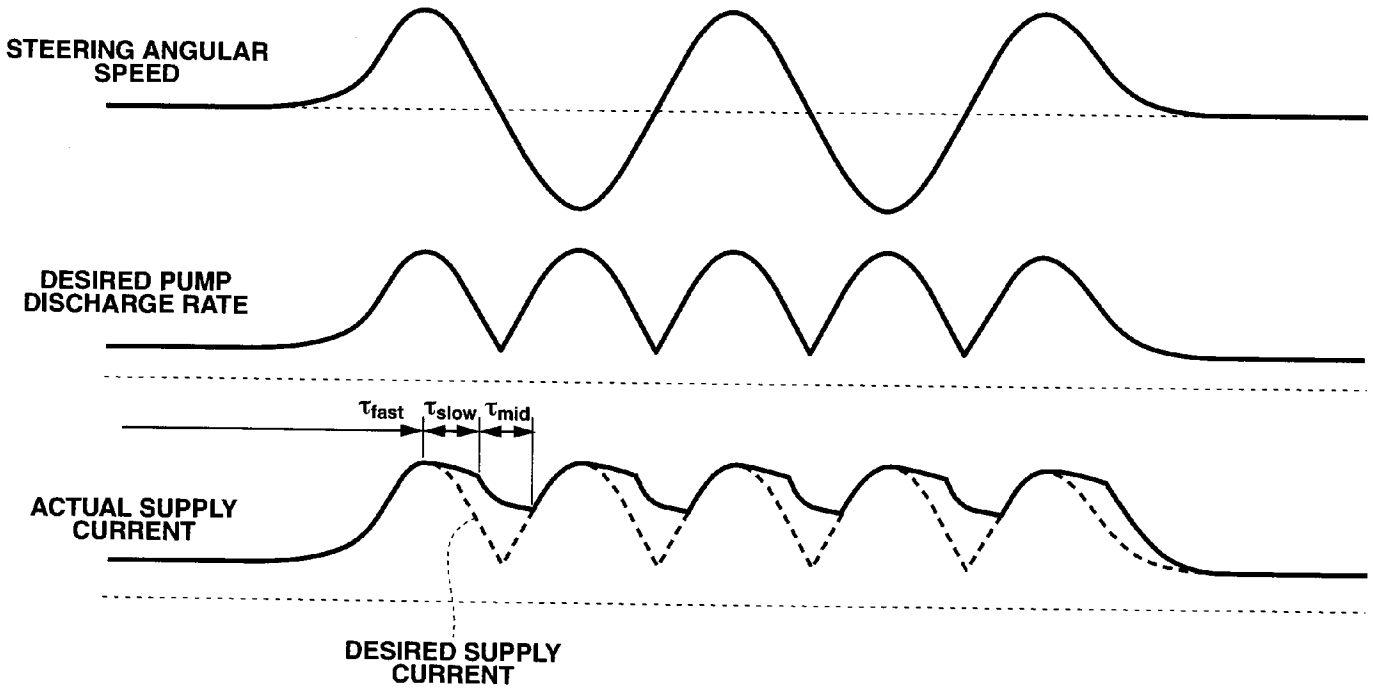
FIGS. 17A, 17B and 17C are time charts showing an example of how the MPU shown in FIG. 15 operates.

FIG. 15 is a block diagram showing configuration of an MPU 104 of a variable displacement pump according to a second embodiment of the present invention. FIG. 16 is a map used by a desired supply current calculation section of the MPU shown in FIG. 15 for calculating a desired supply current. FIGS. 17A, 17B and 17C are time charts showing an example of how the MPU shown in FIG. 15 operates when a steering angular speed is changed at a constant vehicle speed. FIG. 17A shows changes of the steering angular speed, FIG. 17B shows changes of a desired pump discharge rate, and FIG. 17C shows changes of an actual supply current flowing through the solenoid unit 50*a*.

MPU 104 is configured based on MPU 81 of the first embodiment, and provided with a PI gain calculation section 105 instead of peak holding section 97. PI gain calculation section 105 sets PI gains such as a gain for a proportional term and a gain for an integral term to which PWM drive control section 98 refers. Desired supply current calculation section 106 is corresponding to basic supply current calculation section 96 of the first embodiment, and is configured to calculate a desired supply current with reference to the desired pump discharge rate calculated by desired pump discharge rate calculation section 95, using a map shown in FIG. 16. The other part of the variable displacement pump is the same as in the first embodiment.

PI gain calculation section 105 serves as a time constant adjustment means for adjusting a time constant which relates to PWM drive control section 98. This is implemented by calculating the PI gains of PWM drive control section 98 with reference to changes of the desired supply current. Specifically, as shown in FIG. 17C, the PI gain calculation section 105 sets the PI gains so that the time constant of PWM drive control section 98 is equal to a first set value $T_{fast}$ when the desired supply current is increasing, and sets the PI gains so that the time constant of PWM drive control section 98 is equal to a second set value $T_{slow}$ when the desired supply current starts to decrease. The second set value $T_{slow}$ is larger than the first set value $T_{fast}$. When the actual supply current is larger than the desired supply current a predetermined period after the PI gains are set to achieve the second set value $T_{slow}$, the PI gain calculation section 105 sets the PI gains so as to set the time constant of PWM drive control section 98 to a third set value $T_{mid}$ which is smaller than the second set value $T_{slow}$ and larger than the first set value $T_{fast}$. In this way, PI gain calculation section 105 sets the time constant of PWM drive control section 98 larger when the desired supply current is decreasing than when the desired supply current is increasing. As a result, the actual supply current is larger than the desired supply current when the desired supply current is decreasing, and therefore, the actual supply current is larger in a case where the desired supply current is increased after decreasing, than in a case where the desired supply current is increased after the condition that the desired supply current is held constant, or after the condition that the actual supply current is equal to the desired supply current. In other words, operation of solenoid unit 50*a* is controlled so that the cross-sectional flow area of metering orifice 60 is larger when the desired supply current increases under the condition that the cam ring 12 is moving in the direction to reduce the specific discharge rate, than when the desired supply current increases under the condition that the cam ring 12 is stationary.

Figure 18:
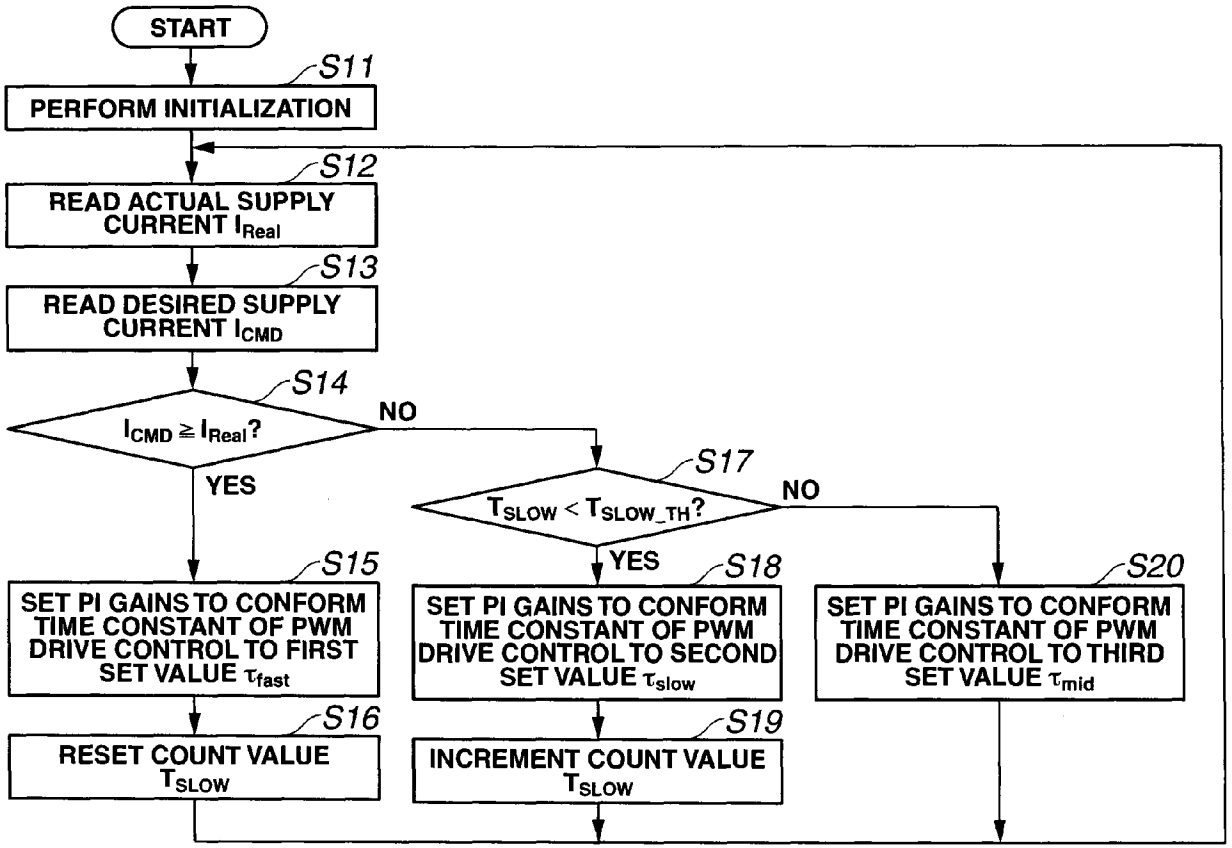
FIG. 18 is a flow chart showing a process performed by a PI gain calculation section of the MPU shown in FIG. 15.

FIG. 18 is a flow chart showing a process performed by PI gain calculation section 105 shown in FIG. 15. As shown in FIG. 18, at Step S11, PI gain calculation section 105 performs initialization. At Step S12, PI gain calculation section 105 reads an actual supply current $I_{Real}$. At Step S13, PI gain calculation section 105 reads a desired supply current $I_{CMD}$ which is calculated by desired supply current calculation section 106. At Step S14, PI gain calculation section 105 determines whether or not the desired supply current $I_{CMD}$ is larger than or equal to the actual supply current $I_{Real}$. When the answer to Step S14 is YES, i.e. when the actual supply current is to be increased, then PI gain calculation section 105 proceeds to Step S15 at which PI gain calculation section 105 sets the PI gains so that the time constant of PWM drive control section 98 conforms to the first set value $T_{fast}$. Subsequent to Step S15, at Step S16, PI gain calculation section 105 resets a count value $T_{SLOW}$.

On the other hand, when the answer to Step S14 is NO, then PI gain calculation section 105 proceeds to Step S17 at which PI gain calculation section 105 determines whether or not the count value $T_{SLOW}$ is smaller than a threshold value $T_{SLOW_TH}$. The count value $T_{SLOW}$ is used for measuring a period elapsed after the time constant of PWM drive control section 98 is set to the second set value $T_{slow}$.

When the answer to Step S17 is YES, then PI gain calculation section 105 proceeds to Step S18 at which PI gain calculation section 105 sets the PI gains so that the time constant of PWM drive control section 98 conforms to the second set value $T_{slow}$. Then, at Step S19, PI gain calculation section 105 increments the count value $T_{SLOW}$, and then returns to Step S12. On the other hand, when the answer to Step S17 is NO, i.e. when the predetermined period is elapsed after the PI gains set to set the time constant of PWM drive control section 98 to the second set value $T_{slow}$, then PI gain calculation section 105 proceeds to Step S20 at which PI gain calculation section 105 sets the PI gains so that the time constant of PWM drive control section 98 conforms to the third set value $T_{mid}$, and then returns to Step S12.

In this way, MPU 104 is programmed to use a longer time constant for control of operation of electromagnetic valve 50 in response to a change of the input signal in a direction to request a decrease in the specific discharge rate than in response to a change of the input signal in a direction to request an increase in the specific discharge rate. Accordingly, operation of solenoid unit 50*a* is controlled so that the response of movement of cam ring 12 is slower when the cam ring 12 moves in the direction to reduce the specific discharge rate in response to a decrease in the desired supply current, than when cam ring 12 moves in the direction to increase the specific discharge rate in response to an increase in the desired supply current. This produces similar advantageous effects as in the first embodiment.

Figure 19:
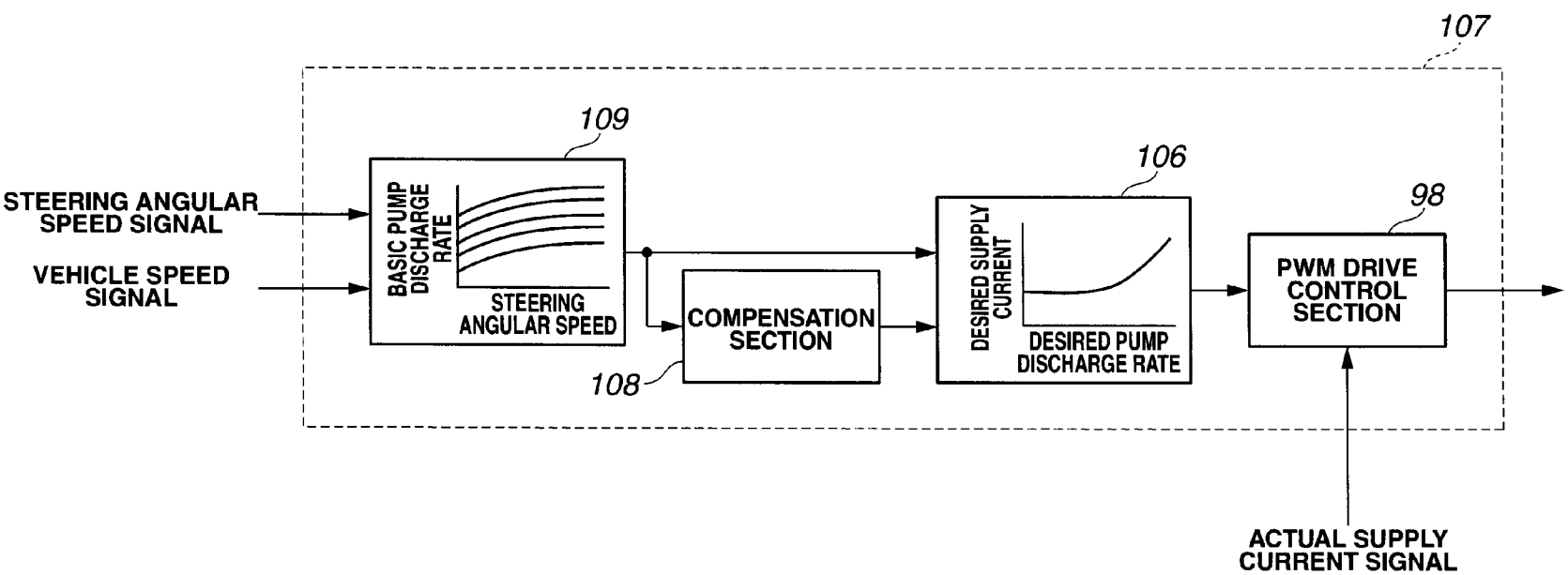
FIG. 19 is a block diagram showing configuration of an MPU of a variable displacement pump according to a third embodiment of the present invention.
Figure 20:
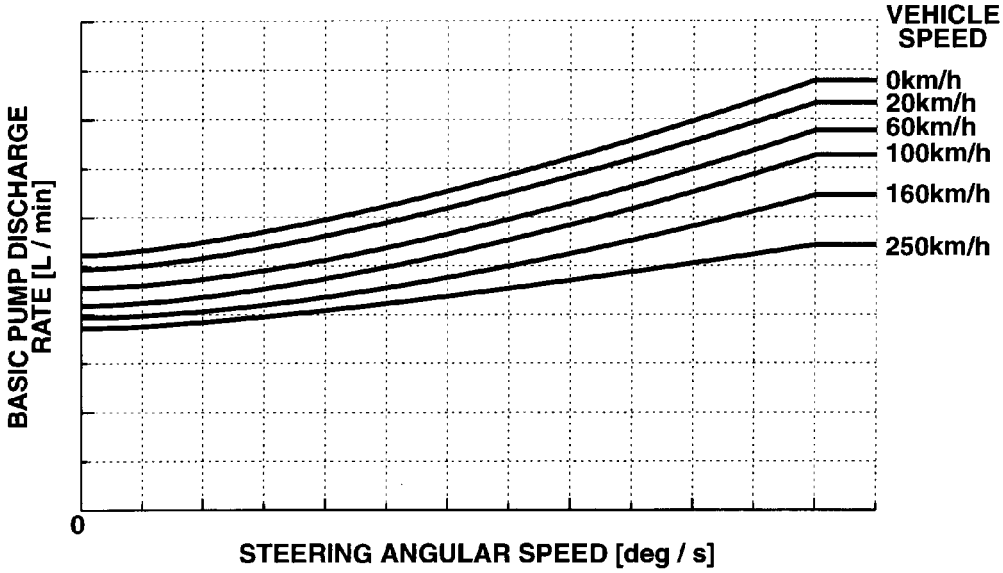
FIG. 20 is a map used by a basic pump discharge rate calculation section of the MPU shown in FIG. 19 for calculating a basic pump discharge rate.
Figure 21:
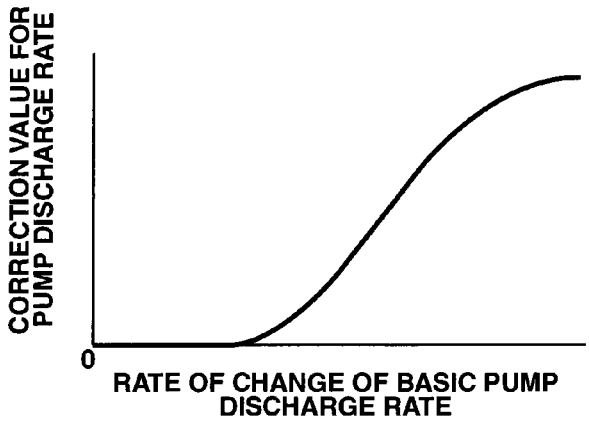
FIG. 21 is a map used by a compensation section of the MPU shown in FIG. 19 for calculating a correction value for pump discharge rate.
Figures 22A, 22B, 22C, 22D, 22E:
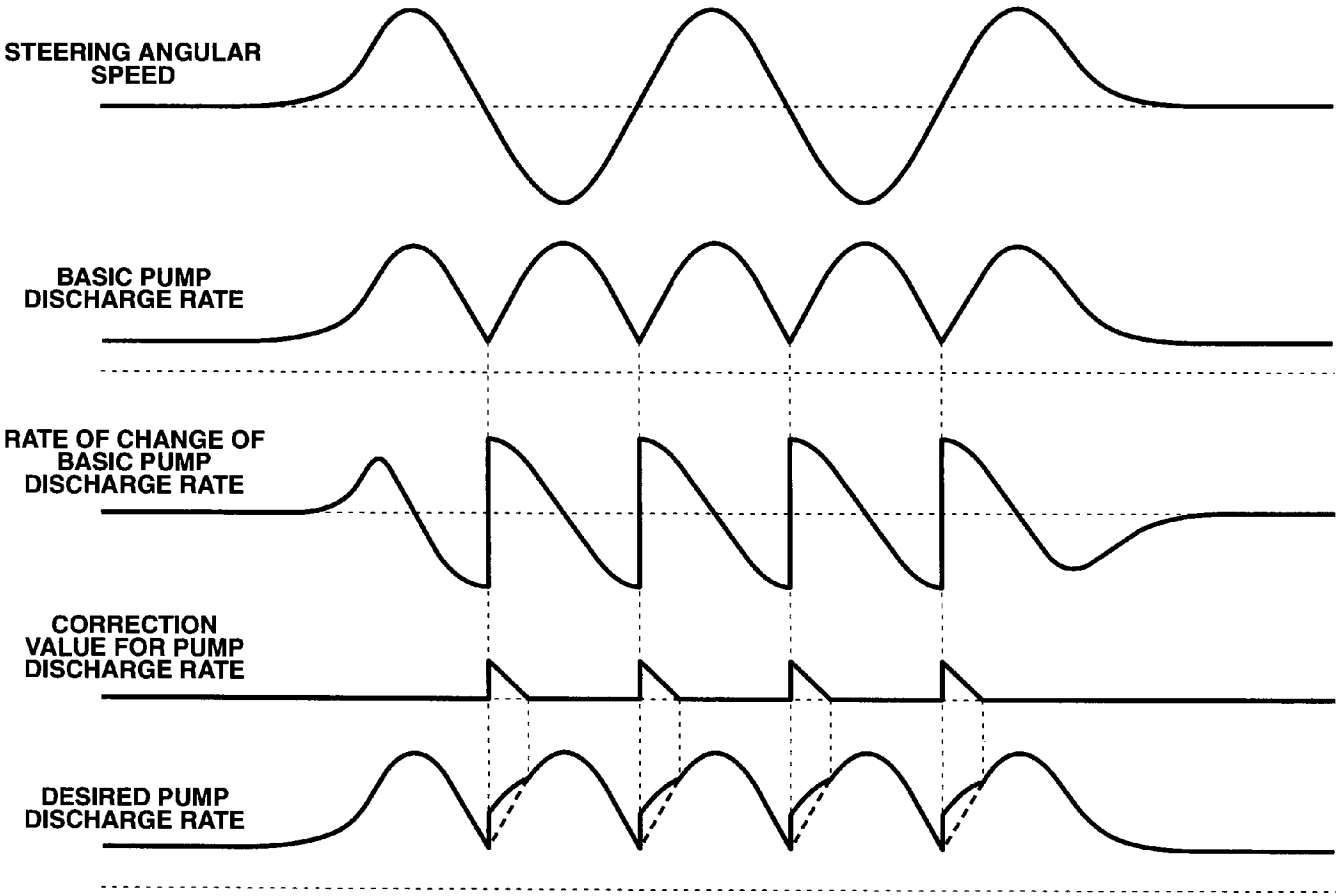
FIGS. 22A, 22B, 22C, 22D and 22E are time charts showing an example of how the MPU shown in FIG. 19 operates.

FIG. 19 is a block diagram showing configuration of an MPU 107 of a variable displacement pump according to a third embodiment of the present invention. FIG. 20 is a map used by a basic pump discharge rate calculation section of MPU 107 for calculating a basic pump discharge rate. FIG. 21 is a map used by a compensation section of MPU 107 for calculating a correction value for pump discharge rate. FIGS. 22A, 22B, 22C, 22D and 22E are time charts showing an example of how MPU 107 operates when a steering angular speed changes at a constant vehicle speed. FIG. 22A shows changes of the steering angular speed, FIG. 22B shows changes of a basic pump discharge rate, FIG. 22C shows changes of a rate of change of the basic pump discharge rate, FIG. 22D shows changes of a correction value for pump discharge rate, and FIG. 22E shows changes of a desired pump discharge rate.

MPU 107 is configured based on MPU 104 of the second embodiment, and provided with a compensation section 108 instead of PI gain calculation section 105, and a basic pump discharge rate calculation section 109 instead of desired pump discharge rate calculation section 95. Basic pump discharge rate calculation section 109 is configured to calculate the basic pump discharge rate with reference to the steering angular speed and the vehicle speed, using the map shown in FIG. 20. The other part of the variable displacement pump is the same as in the second embodiment.

Compensation section 108 calculates a correction value for pump discharge rate with reference to a rate of change of the basic pump discharge rate with respect to time, using the map shown in FIG. 21. As shown in FIGS. 22C and 22D, when the rate of change of the basic pump discharge rate changes from a negative value to a positive value, i.e. when the basic pump discharge rate increases under a condition that the cam ring 12 is moving in the direction to reduce the specific discharge rate, the compensation section 108 calculates the correction value using the map shown in FIG. 21, and outputs the correction value to desired supply current calculation section 106. The correction value is gradually reduced linearly with time. In other words, compensation section 108 determines with reference to the rate of change of the basic pump discharge rate whether cam ring 12 is moving in the direction to increase the specific discharge rate or in the direction to reduce the specific discharge rate, and calculates the correction value using the map shown in FIG. 21 when the movement of cam ring 12 shifts from the direction to reduce the specific discharge rate to the direction to increase the specific discharge rate.

Desired supply current calculation section 106 calculates the desired pump discharge rate shown in FIG. 22E by adding the correction value to the basic pump discharge rate calculated by basic pump discharge rate calculation section 109. Then desired supply current calculation section 106 calculates the desired supply current with reference to the basic pump discharge rate using the map shown in FIG. 16.

According to the features described above, the desired pump discharge rate is larger so that the cross-sectional flow area of metering orifice 60 is larger, when the basic pump discharge rate starts to increase under the condition that the cam ring 12 is moving in the direction to reduce the specific discharge rate, than when the basic pump discharge rate starts to increase under the condition that cam ring 12 is stationary.

Figure 23:
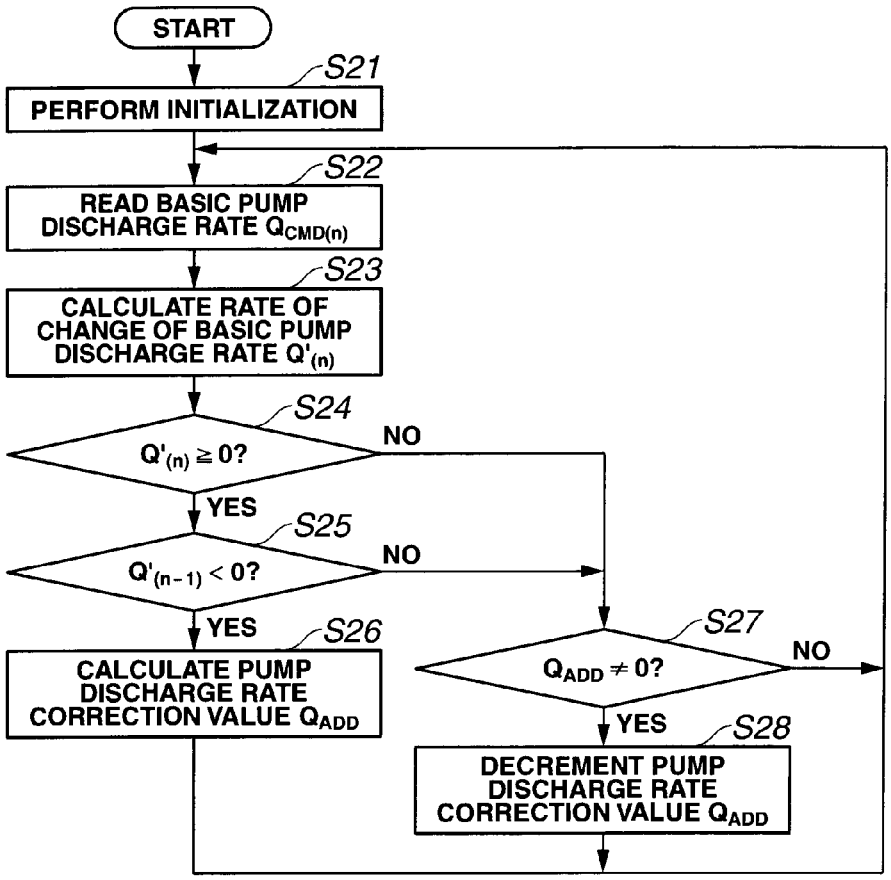
FIG. 23 is a flow chart showing a process performed by the compensation section of the MPU shown in FIG. 19.

FIG. 23 is a flow chart showing a process performed by compensation section 108. As shown in FIG. 23, at Step S21, compensation section 108 performs initialization. At Step S22, compensation section 108 reads a basic pump discharge rate $Q_{CMD(n)}$. At Step S23, compensation section 108 calculates a rate of change of the basic pump discharge rate Q'(n). At Step S24, compensation section 108 determines whether or not the rate of change of the basic pump discharge rate Q'(n) is larger than or equal to zero. When the answer to Step S24 is YES, then compensation section 108 proceeds to Step S25 at which compensation section 108 determines whether or not the last value of the rate of change of the basic pump discharge rate Q'(n−1) is smaller than zero.

When the answer to Step S25 is YES, i.e. when the rate of change of the basic pump discharge rate Q' has changed from a negative value to a value larger than or equal to zero, then compensation section 108 proceeds to Step S26 at which compensation section 108 calculates the correction value $Q_{ADD}$ using the map shown in FIG. 21, and then returns to Step S22.

On the other hand, when at least one of the conditions of Steps S24 and S25 is unsatisfied, i.e. when the answer to Step S24 is NO and/or the answer to Step S25 is NO, then compensation section 108 proceeds to Step S27 at which compensation section 108 determines whether or not the correction value $Q_{ADD}$ is different from zero. When the answer to Step S27 is YES, then compensation section 108 proceeds to Step S28 at which compensation section 108 performs a decline operation of decrementing the correction value $Q_{ADD}$, and then returns to Step S22. In this way, the correction value $Q_{ADD}$ is changed to decline toward zero with time. On the other hand, when the answer to Step S27 is NO, i.e. when the correction value $Q_{ADD}$ has reached zero, then compensation section 108 returns to Step S22.

In this way, operation of solenoid unit 50*a* is controlled so that the response of movement of cam ring 12 is slower when the cam ring 12 moves in the direction to reduce the specific discharge rate in response to a decrease in the basic pump discharge rate, than when cam ring 12 moves in the direction to increase the specific discharge rate in response to an increase in the basic pump discharge rate. This produces similar advantageous effects as in the first embodiment.

Figure 24:
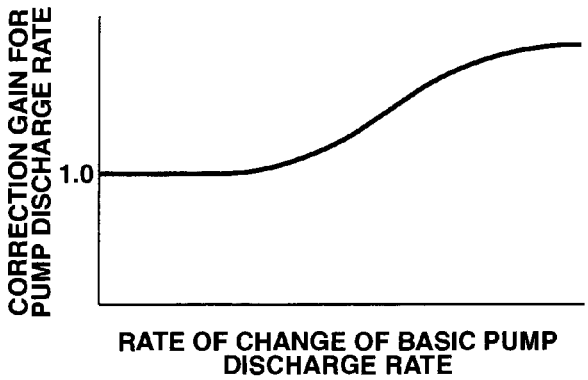
FIG. 24 is a map used by a compensation section of an MPU of a variable displacement pump according to a first modification of the third embodiment for calculating a correction gain for pump discharge rate.

The configuration that the desired supply current calculation section 106 calculates the desired pump discharge rate by summing the basic pump discharge rate and the correction value calculated by compensation section 108, may be modified so that the compensation section 108 calculates a correction gain for pump discharge rate, using a map shown in FIG. 24. In this modification, desired supply current calculation section 106 calculates the desired pump discharge rate by multiplying the basic pump discharge rate by the correction gain calculated by compensation section 108. The correction gain is increased with an increase in the rate of change of the basic discharge rate, as shown in FIG. 24. The desired supply current is calculated with reference to the desired pump discharge rate. The variable displacement pump according to the modification produces similar advantageous effects as in the third embodiment.

Figure 25:
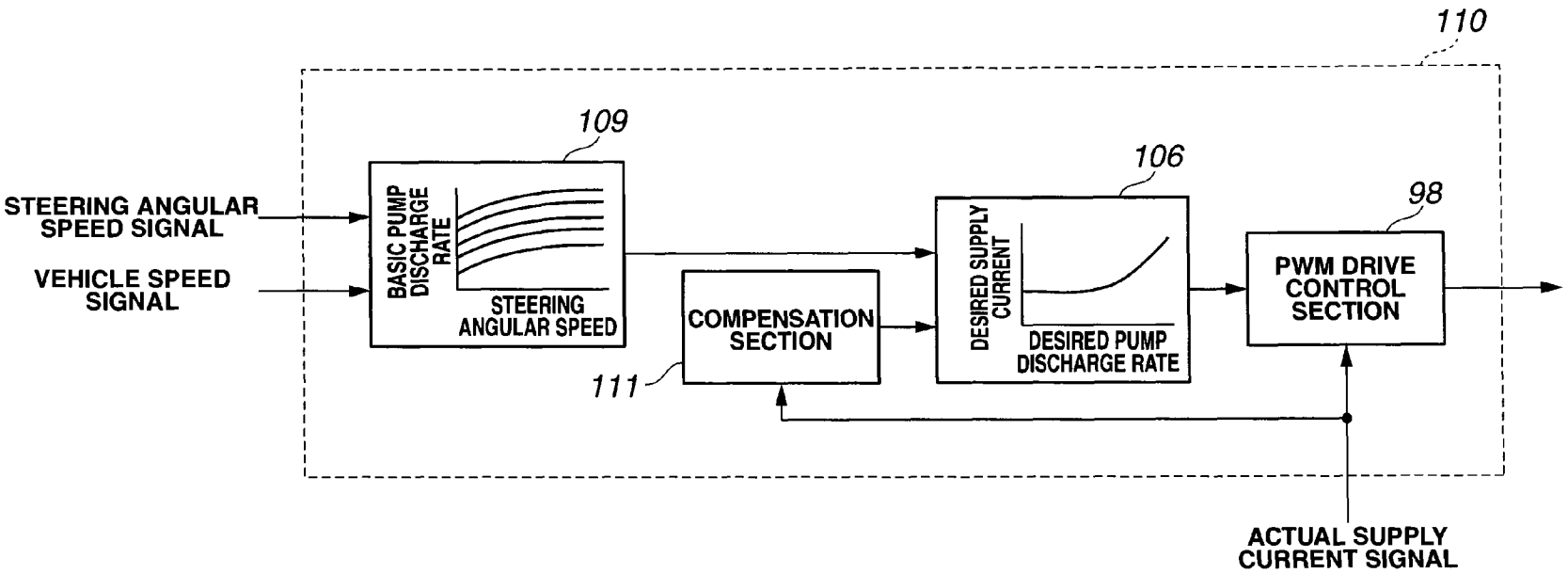
FIG. 25 is a block diagram showing configuration of an MPU of a variable displacement pump according to a second modification of the third embodiment.
Figure 26:
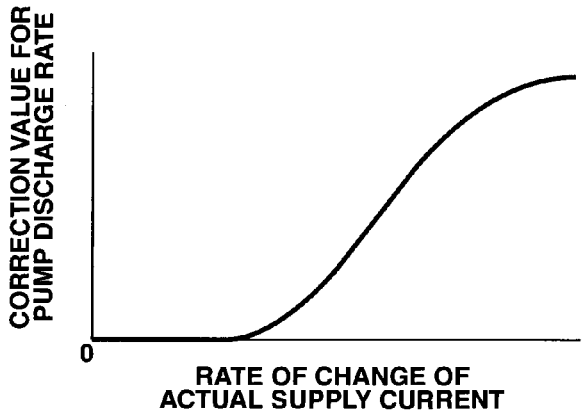
FIG. 26 is a map used by a compensation section of the MPU shown in FIG. 25 for calculating a correction value for pump discharge rate.
Figure 27:
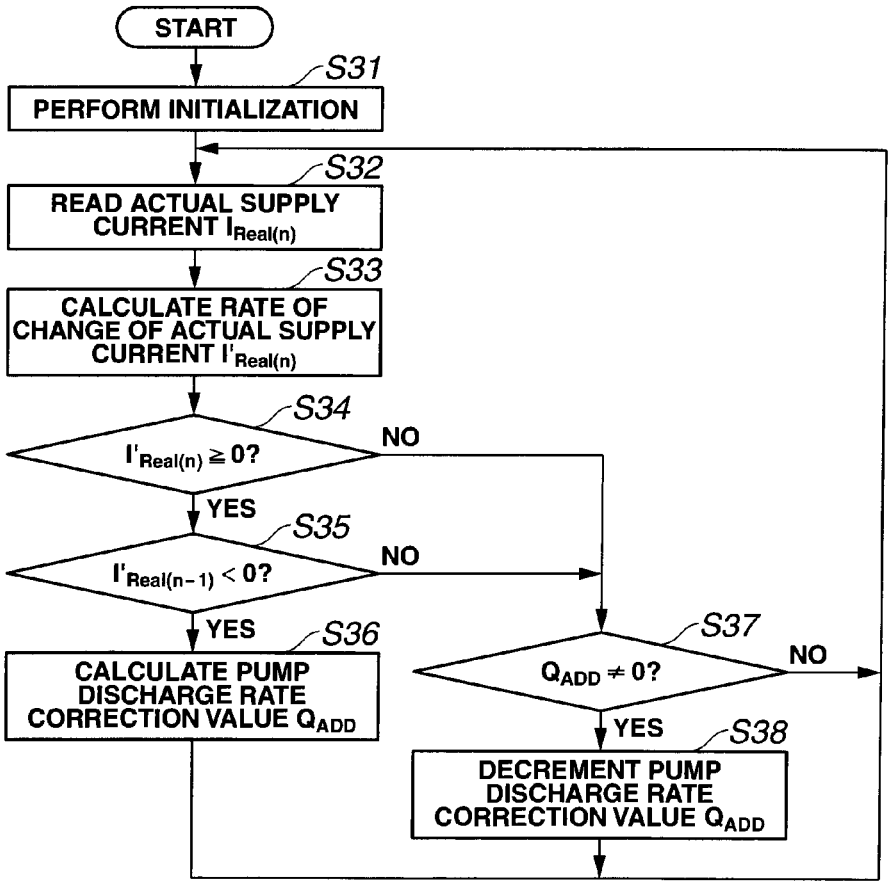
FIG. 27 is a flow chart showing a process performed by the compensation section of the MPU shown in FIG. 25.

FIGS. 25 to 27 show a variable displacement pump according to a second modification of the third embodiment. FIG. 25 is a block diagram showing configuration of an MPU 110. FIG. 26 is a map used by a compensation section 111 of MPU 110 for calculating a correction value for pump discharge rate. FIG. 27 is a flow chart showing a process performed by compensation section 111.

In the second modification, compensation section 111 is configured to receive input of an actual supply current signal, and calculate a correction value for pump discharge rate with reference to a rate of change of the actual supply current with respect to time, using a map shown in FIG. 26. The other part of the variable displacement pump is the same as in the third embodiment.

As shown in FIG. 27, at Step S31, compensation section 111 performs initialization. At Step S32, compensation section 111 reads an actual supply current $I_{Real(n)}$. At Step S33, compensation section 111 calculates a rate of change of the actual supply current $I_{Real'(n)}$. At Step S34, compensation section 111 determines whether or not the rate of change of the actual supply current $I_{Real'(n)}$ is larger than or equal to zero. When the answer to Step S34 is YES, then compensation section 111 proceeds to Step S35 at which compensation section 111 determines whether or not the last value of the rate of change of the actual supply current $I_{Real'(n-1)}$ is smaller than zero.

When the answer to Step S35 is YES, i.e. when the rate of change of the actual supply current $I_{Real}$ has changed from a negative value to a value larger than or equal to zero, then compensation section 111 proceeds to Step S36 at which compensation section 111 calculates the correction value $Q_{ADD}$ using the map shown in FIG. 26, and then returns to Step S32. In other words, compensation section 111 determines with reference to the rate of change of the actual supply current $I_{Real}$ whether cam ring 12 is moving in the direction to increase the specific discharge rate or in the direction to reduce the specific discharge rate, and calculates the correction value using the map shown in FIG. 21, when the movement of cam ring 12 shifts from the direction to reduce the specific discharge rate to the direction to increase the specific discharge rate.

On the other hand, when at least one of the conditions of Steps S34 and S35 is unsatisfied, i.e. when the answer to Step S34 is NO and/or the answer to Step S35 is NO, then compensation section 111 proceeds to Step S37 at which compensation section 111 determines whether or not the correction value $Q_{ADD}$ is different from zero. When the answer to Step S37 is YES, then compensation section 111 proceeds to Step S38 at which compensation section 111 performs a decline operation of decrementing the correction value $Q_{ADD}$, and then returns to Step S32. In this way, the correction value $Q_{ADD}$ is changed to decline toward zero with time. On the other hand, when the answer to Step S37 is NO, i.e. when the correction value $Q_{ADD}$ has reached zero, then compensation section 111 returns to Step S32.

In this way, operation of solenoid unit 50*a* is controlled so that the response of movement of cam ring 12 is slower when the cam ring 12 moves in the direction to reduce the specific discharge rate in response to a decrease in the basic pump discharge rate, than when cam ring 12 moves in the direction to increase the specific discharge rate in response to an increase in the basic pump discharge rate. This produces similar advantageous effects as in the first embodiment.

In the first to third embodiments and the modifications, the response of movement of cam ring 12 in the direction to reduce the specific discharge rate is set slower than in the direction to increase the specific discharge rate, which is effective for preventing the inertia of cam ring 12 from resisting the movement of cam ring 12 in the direction to increase the specific discharge rate. It is preferable to further prevent the movement of cam ring 12 in the direction to increase the specific discharge rate from overshooting, in order to provide a further improved steering feel.

The prevention of overshooting is implemented by controlling the solenoid unit 50*a* so that the cross-sectional flow area of metering orifice 60 decreases immediately before cam ring 12 reaches a target position, while cam ring 12 is moving in the direction to increase the specific discharge rate. The overshooting is prevented or suppressed, because the moving speed of cam ring 12 is lowered immediately before the target position during moving in the direction to increase the specific discharge rate.

The prevention of overshooting may be implemented by controlling the solenoid unit 50*a* so that the moving speed of cam ring 12 gradually decreases as cam ring 12 approaches the target position during moving in the direction to increase the specific discharge rate.

Figure 28:
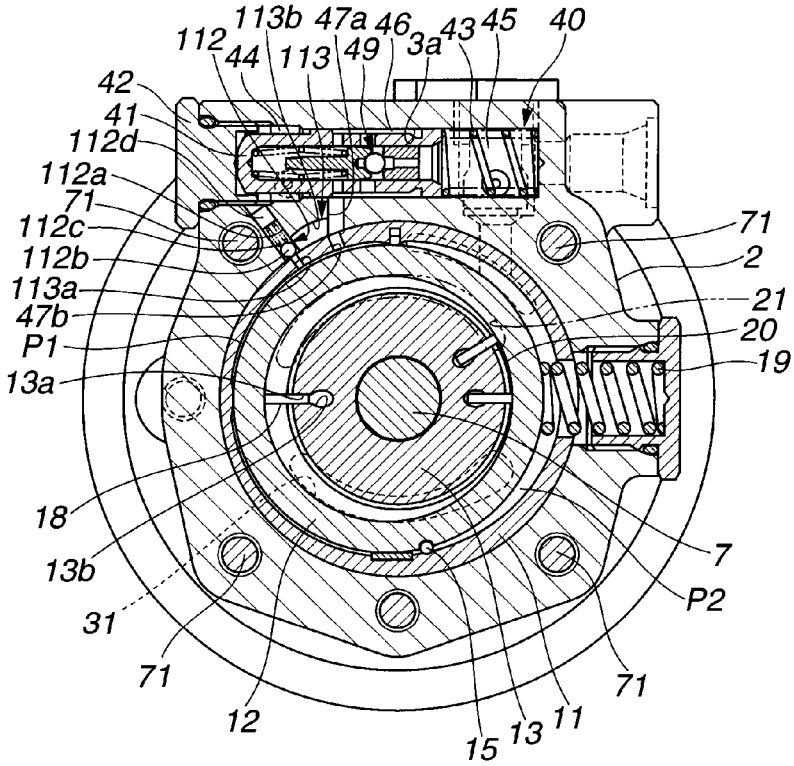
FIG. 28 is a cross-sectional view of a variable displacement pump according to a fourth embodiment of the present invention.
Figure 29:
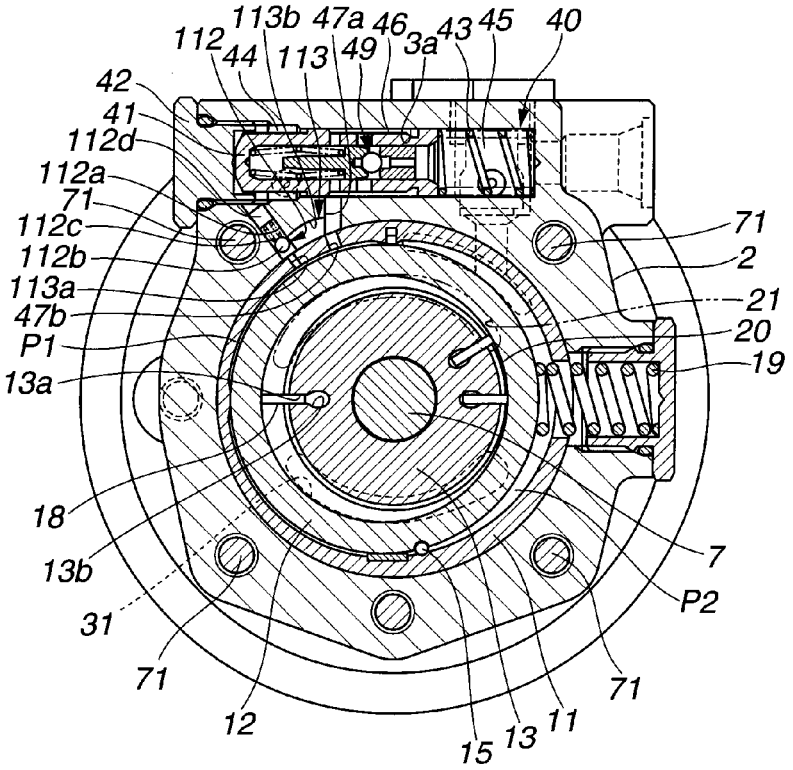
FIG. 29 is a cross-sectional view of the variable displacement pump according to the fourth embodiment under a condition that a check valve is opened.

In the first to third embodiments and the modifications, the delay in the response of movement of cam ring 12 in the direction to increase the specific discharge rate is suppressed by control of solenoid unit 50*a*. However, this may be implemented by a mechanical arrangement as shown in FIGS. 28 and 29, for producing similar advantageous effects. FIG. 28 is a cross-sectional view of a variable displacement pump according to a fourth embodiment of the present invention under a condition that a check valve is closed. FIG. 29 is a cross-sectional view of the variable displacement pump according to the fourth embodiment under a condition that the check valve is opened.

The variable displacement pump according to the fourth embodiment is created based on the first embodiment, and modified so that a bypass passage 113 is provided between the first fluid pressure chamber P1 and communication passage 47*a* for fluid connection therebetween without connection through the communication passage 47*b*.

Bypass passage 113 is composed of a hole 113*a*, a recess 113*b*, and a check valve 112. Hole 113*a* is formed in adapter ring 11. Recess 113*b* is formed in the cylinder section 3 of front body 2, and hydraulically connected between the hole 113*a* and the communication passage 47*a*. As shown in FIG. 28, recess 113*b* has a half-round section. Check valve 112 is arranged to allow working fluid to flow from the hole 113*a* to the recess 113*b*, and prevents working fluid from flowing inversely.

Check valve 112 includes a valve bore 112*a*, a valve element 112*b*, a valve spring 112*c*, and a plug 112*d*. Valve bore 112*a* is formed in the cylinder section 3 of front body 2, and is continuous with the hole 113*a*. Valve element 112*b* is spherically shaped, and mounted in the valve bore 112*a*. Valve spring 112*c* is arranged to urge the valve element 112*b* toward the adapter ring 11. The open end of valve bore 112*a* opposite to adapter ring 11 is closed by plug 112*d*. The cylinder section 3 of front body 2 thus constitutes the check valve 112 as a valve body.

When working fluid is flowing from control valve 40 to first fluid pressure chamber P1, check valve 112 presses the valve element 112*b* to adapter ring 11 by the urging force of valve spring 112*c*, and thereby closes the opening of hole 113*a*, so that the flow of working fluid through the bypass passage 113 is prevented. On the other hand, when working fluid is flowing from first fluid pressure chamber P1 to control valve 40, check valve 112 releases the valve element 112*b* from adapter ring 11 against the urging force of valve spring 112*c*, and thereby opens the opening of hole 113*a*, so that the flow of working fluid through the bypass passage 113 is allowed.

According to the structure described above, when cam ring 12 is moving in the direction to increase the eccentricity of cam ring 12 with respect to rotor 13 or in the direction to reduce the volumetric capacity of first fluid pressure chamber P1, working fluid flows from first fluid pressure chamber P1 to control valve 40 so as to open the check valve 112, so that the working fluid in first fluid pressure chamber P1 flows out through the bypass passage 113 as well as the communication passage 47*b*, as shown in FIG. 29. This allows the cam ring 12 to be relatively quickly moved. On the other hand, when cam ring 12 is moving in the direction to reduce the eccentricity of cam ring 12 with respect to rotor 13 or in the direction to increase the volumetric capacity of first fluid pressure chamber P1, working fluid flows from control valve 40 to first fluid pressure chamber P1 so as to close the check valve 112, so that the working fluid flows into first fluid pressure chamber P1 only through the communication passage 47*b*, as shown in FIG. 28. It takes more time to charge the first fluid pressure chamber P1 with working fluid. As a result, movement of the cam ring 12 is relatively slowed. In summary, the response of movement of cam ring 12 in the direction to reduce the specific discharge rate is set slower than in the direction to increase the specific discharge rate.

The variable displacement pump according to the fourth embodiment is effective for suppressing the acceleration of cam ring 12 in the direction to reduce the specific discharge rate, and thereby quickly moving the cam ring 12 when the movement of cam ring 12 shifts from the direction to reduce the specific discharge rate to the direction to increase the specific discharge rate, because the inertia force of cam ring 12 is smaller.

The entire contents of Japanese Patent Application 2008-208304 filed Aug. 13, 2008 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable displacement pump for supplying working fluid to a hydraulic device mounted on a vehicle, the variable displacement pump comprising:

a body;

a drive shaft rotatably supported by the body;

a rotor mounted in the body, and arranged to be rotated by the drive shaft;

a cam ring mounted radially outside of the rotor in the body, and arranged to move with a change in an eccentricity of the cam ring with respect to the rotor, wherein change of the eccentricity causes a change in a specific discharge rate as a quantity of discharge of working fluid per one rotation of the rotor;

an electromagnetic actuator arranged to actuate the cam ring for regulating the eccentricity; and a controller configured to: receive an input signal outputted from a sensor arranged to measure a state of operation of the vehicle; and output a drive signal to the electromagnetic actuator, wherein the controller is programmed to:

control operation of the electromagnetic actuator with reference to the input signal by outputting the drive signal; and set a first response slower than a second response, during control of operation of the electromagnetic actuator, wherein the first response is a response of movement of the cam ring to a change of the input signal in a first direction to request a decrease in the specific discharge rate, and the second response is a response of movement of the cam ring to a change of the input signal in a second direction to request an increase in the specific discharge rate, wherein the variable displacement pump further comprises:

a discharge passage formed in the body for guiding working fluid to outside of the body after the working fluid is pressurized by a pumping effect resulting from rotation of the rotor;

a metering orifice provided in the discharge passage;

a first fluid pressure chamber defined radially outside of the came ring in the body, and arranged to contract with an increase in the eccentricity;

a second fluid pressure chamber defined radially outside of the cam ring in the body, and arranged to contract with a decrease in the eccentricity; and a control valve arranged to regulate at least one of an internal pressure of the first fluid pressure chamber and an internal pressure of second fluid pressure chamber with a valve element arranged to be operated by a differential pressure between an upstream side and a downstream side of the metering orifice, wherein the electromagnetic actuator is arranged to regulate a cross-sectional flow area of the metering orifice for actuating the cam ring with the control valve;

wherein the control valve is arranged so that the specific discharge rate increases with an increase in the cross-sectional flow area of the metering orifice;

wherein the controller is programmed to set the cross-sectional flow area of the metering orifice to be larger in response to a change of the input signal in the second direction when the cam ring is moving in a direction to reduce the specific discharge rate than when the cam ring is stationary, and wherein the controller is programmed to determine with reference to an actual supply current flowing through the electromagnetic actuator whether the cam ring is moving in the direction to reduce the specific discharge rate or in a direction to increase the specific discharge rate.

2. The variable displacement pump as claimed in claim 1, wherein the controller is programmed to determine with reference to a change of the actual supply current whether the cam ring is moving in the direction to reduce the specific discharge rate or in the direction to increase the specific discharge rate.

3. The variable displacement pump as claimed in claim 1, wherein the controller is programmed to use a longer time constant for control of operation of the electromagnetic actuator in response to a change of the input signal in the first direction than in response to a change of the input signal in the second direction.

4. The variable displacement pump as claimed in claim 1, wherein the metering orifice includes:

a variable orifice having a cross-sectional flow area that is regulated by the electromagnetic actuator; and a constant orifice arranged in parallel to the variable orifice.

5. The variable displacement pump as claimed in claim 1, wherein the electromagnetic actuator is arranged to press the valve element of the control valve with the differential pressure in a direction to change a state of flow of the control valve.

6. The variable displacement pump as claimed in claim 1, wherein:

the hydraulic device is a hydraulic power steering device; and the controller is programmed to change the specific discharge rate with reference to a travel speed of the vehicle.

7. The variable displacement pump as claimed in claim 6, wherein the controller is programmed to increase the specific discharge rate with a decrease in the travel speed of the vehicle.

8. The variable displacement pump as claimed in claim 1, wherein the controller is programmed to prevent the cam ring from overshooting a target position, by reducing the specific discharge rate, immediately before the target position, while the cam ring is moving in the direction to increase the specific discharge rate.

9. The variable displacement pump as claimed in claim 1, wherein the controller is programmed to reduce a speed of the cam ring as the cam ring approaches a target position, while the cam ring is moving in the direction to increase the specific discharge rate.

10. The variable displacement pump as claimed in claim 1, wherein the controller is configured to wait a predetermined delay period before allowing the cam ring to move in the direction to reduce the specific discharge rate, in response to a change of the input signal in the first direction during control of operation of the electromagnetic actuator.

* * * * *